US011492832B2

(12) United States Patent
Hernandez

(10) Patent No.: US 11,492,832 B2
(45) Date of Patent: Nov. 8, 2022

(54) PANEL SYSTEM FOR SLIDING DOORS OR PANELS

(71) Applicant: GLAZCON PRODUCTION, INC., Bermuda Dunes, CA (US)

(72) Inventor: Mario Hernandez, Palm Desert, CA (US)

(73) Assignee: GLAZCON PRODUCTION, INC., Bermuda Dunes, CA (US)

( * ) Notice: Subject to any disclaimer, the term of this patent is extended or adjusted under 35 U.S.C. 154(b) by 209 days.

(21) Appl. No.: 16/912,631

(22) Filed: Jun. 25, 2020

(65) Prior Publication Data

US 2020/0408016 A1 Dec. 31, 2020

Related U.S. Application Data

(60) Provisional application No. 62/868,759, filed on Jun. 28, 2019.

(51) Int. Cl.
*E05D 15/06* (2006.01)
*E06B 1/70* (2006.01)
(Continued)

(52) U.S. Cl.
CPC ..... *E05D 15/0665* (2013.01); *E06B 1/70* (2013.01); *E06B 3/4681* (2013.01); *E06B 7/14* (2013.01); *E06B 7/22* (2013.01); *E05Y 2900/132* (2013.01)

(58) Field of Classification Search
CPC ..... E05D 15/0665; E05D 15/0678; E05D 15/0682
See application file for complete search history.

(56) References Cited

U.S. PATENT DOCUMENTS 4,282,631 A * 8/1981 Uehara ..... E05D 15/581 16/105
2005/0012816 A1* 1/2005 Becken ..... E05D 15/0665 348/107
(Continued)

FOREIGN PATENT DOCUMENTS

DE 102018108180 A1 * 11/2018 ..... E05D 15/56
EP 2400100 A1 * 12/2011 ..... E06B 1/325
(Continued)

OTHER PUBLICATIONS

International Search Report and Written Opinion of the International Searching Authority for International Application No. PCT/US2020/039507, dated Sep. 15, 2020, in 11 pages.
(Continued)

*Primary Examiner* — Marcus Menezes
(74) *Attorney, Agent, or Firm* — Knobbe, Martens, Olson & Bear, LLP

(57) ABSTRACT

A sliding door or panel system is provided. The system can have a roller assembly that is mounted onto a sill. The system can have a moveable door or panel with a blade extending from a bottom rail of the door or panel. The blade can rest on the rollers and the rollers facilitate the door or panel moving longitudinally along the sill. The sill can be installed below a top surface of a floor, making the system less visible. The system can include a brush insert that protects against debris entering the sill. The brush insert can be removed from the sill to allow access to the rollers.

9 Claims, 21 Drawing Sheets

(51) Int. Cl.

| | |
|---|---|
| ***E06B 7/22*** | (2006.01) |
| ***E06B 7/14*** | (2006.01) |
| ***E06B 3/46*** | (2006.01) |

(56) References Cited

U.S. PATENT DOCUMENTS

| | | | | |
|---|---|---|---|---|
| 2009/0019665 | A1* | 1/2009 | Kelley | E05D 15/066 16/105 |
| 2009/0077766 | A1* | 3/2009 | Proctor | E05D 15/0665 16/97 |
| 2012/0005975 | A1* | 1/2012 | Kim | E06B 7/14 52/656.5 |
| 2012/0291392 | A1* | 11/2012 | Joray | E05D 15/0682 52/656.5 |
| 2014/0202083 | A1* | 7/2014 | Joray | E05D 15/0691 49/425 |
| 2015/0240552 | A1* | 8/2015 | Kim | E05D 15/0665 49/411 |
| 2019/0003227 | A1* | 1/2019 | McCoy | E06B 1/702 |
| 2019/0169921 | A1* | 6/2019 | De Sousa Guedes | E06B 3/4609 |
| 2019/0194991 | A1* | 6/2019 | Fontijn | E06B 3/46 |
| 2019/0226257 | A1* | 7/2019 | Fontijn | E05D 15/0656 |
| 2019/0264484 | A1* | 8/2019 | Tuminella | E05D 15/0652 |
| 2019/0383078 | A1* | 12/2019 | Tsimbikos | E06B 3/46 |
| 2020/0157865 | A1* | 5/2020 | Terno | E05D 15/0665 |

FOREIGN PATENT DOCUMENTS

| | | | | |
|---|---|---|---|---|
| EP | 2546448 | A2 | 1/2013 | |
| EP | 3425148 | A1 * | 1/2019 | |
| EP | 3599332 | A1 * | 1/2020 | |
| KR | 10-1202127 | B1 | 11/2012 | |
| KR | 10-1819888 | B1 | 2/2018 | |
| KR | 10-1932031 | B1 | 12/2018 | |
| WO | WO-0120115 | A1 * | 3/2001 | E05D 15/0686 |
| WO | WO-2013151293 | A1 * | 10/2013 | E05D 15/0621 |
| WO | WO-2014121350 | A1 * | 8/2014 | E04F 21/0023 |

OTHER PUBLICATIONS

EDGE | s |—Conceptual Design, dated Apr. 6, 2020.
Norwood SS Track Install & Removal, Fleetwood Windows & Doors, dated May 7, 2004.
Sill, Fusion System, Otiima, dated Jul. 27, 2018.
Sill, Sky-Frame Plain, known on or before Jan. 1, 2019.
Sill, VistaMax, dated Oct. 20, 2016.
Sill, Vitrocsa Swimms Insulated, dated 2015.

* cited by examiner

PANEL SYSTEM FOR SLIDING DOORS OR PANELS

CROSS-REFERENCE TO RELATED APPLICATIONS

This application claims priority to U.S. Provisional Application No. 62/868,759, filed Jun. 28, 2019, titled TRACK ASSEMBLY FOR SLIDING DOORS OR PANELS, the entirety of which is incorporated herein by reference and made a part of this specification.

BACKGROUND

Field

The present disclosure relates generally to sliding door or panel systems, and track assemblies for the same.

Description of the Related Art

Sliding doors have a moveable portion that can slide horizontally away from a wall to create an opening between the moveable portion and the wall. The sliding door can be opened partially or fully as desired. When fully opened, the moveable portion can be positioned behind an immobile portion so that the immobile portion fully overlaps the moveable portion. To close the sliding door, the moveable portion can be drawn horizontally away from the immobile portion until the moveable portion extends fully from the immobile portion to the wall. Sliding doors and panels offer versatility in interior design. A need exists for sliding doors and panels that provide different options for styling architectural designs.

SUMMARY

Disclosed herein are various embodiments of a sliding door system, such as patio doors, that include a subterranean sill and roller assembly. Disclosed are sliding door and/or window assemblies, and more particularly, sill portions of the panel(s), and the sill assembly on which the operable panel(s) travel horizontally, which can be flush to the floor or walking surface to maintain a low profile and allow for direction of precipitation/water into the sill assembly and drainage to the exterior.

Sliding doors or patio doors, multi-slide doors including glass doors, and pocketing door assemblies, can be placed in a frame which surrounds the entire assembly of panels. The frame can include a sill portion which runs the full width of the frame assembly. The frame assembly supports panels which may be either: fixed in place and non-operable; operable in such a way that they are able to travel along the full or partial length of the sill assembly; or any combination of fixed and operable panels.

The sill assemblies can be placed on slab, or rough (unfinished) flooring above grade level. Interior flooring material such as wood or tile is placed over the slab, or rough flooring, up to the inside surface of the sill assembly, and the exterior of the assembly can be kept free of obstruction. Moisture, water, or precipitation that enters the sill assembly is directed to the exterior of the sill and removed via weep slots, notches, or other opening for drainage.

Disclosed herein are sill assemblies for sliding door and/or window frames and panels in which sliding panels can be placed and run horizontally within the entire frame assembly. While the sill assembly disclosed herein can be used with operable panels, the assembly can also be used for fixed (stationary) panels, and is not limited to sliding door or window panels, but may also be used for other types of operable and fixed panels.

Sill assemblies disclosed herein can consist of a single or multiple bases. Each base can have a single slot, assembled together, with a key, or other method which secures the bases together. Each base can include walls and support members which form a cavity and screw races for attachment and alignment with jamb assemblies. The sill assembly can be attached to the jambs and head assemblies using screws or other fasteners and can installed so that the finished flooring will align flush with the uppermost surface of the finished sill assembly with substantially no part of the sill assembly extending above the walking surface. The assembly includes a surface on which flooring can be placed to extend from the interior to the exterior, at the substantially the same level, with interruption or an opening at the locations where the sliding panels will operate.

Sill assemblies disclosed herein can include an integrated cavity where roller cartridges are placed, at varying distances from each other, depending on the required panel size, and over which the panel will travel. The sill assemblies can be fabricated and assembled with staggered tracks so that substantially no portion of the sill assembly is visible from the exterior when the panels are placed in the closed position.

The roller cartridges disclosed herein can be self-adjusting. The roller cartridges can pivot on an axle as the panel travels over the cartridge, allowing for a smooth and silent transition onto, and over the cartridge. The rollers in the cartridge can have a concave edge, which helps to maintain the panel centered in the sill assembly.

The top of the roller cartridges can be below the top of the sill assembly and can be partially concealed by a set of removable brush holders. The brush holders can each support a brush weather-strip which reduces the amount of debris which may enter the cavity of the sill assembly. The brush holders can form the top edge of the sill assembly, which can be aligned with the flooring, and can also serve to partially conceal the roller cartridges by reducing the overall width of the cavity. The integrated cavity in the sill assembly can also accept a fixed panel support. The integrated cavity can position the fixed panel(s) in the center of a sill assembly and can align the fixed panel vertically with adjacent panels.

Sill assemblies disclosed herein can be fabricated with slots for drainage that run perpendicular to the length of the sill assembly. The drainage can extend or span across the entire bottom width of the sill assembly, spaced at various distances, depending on drainage requirements, which allow for drainage of water or moisture that enters the sill assembly. The sill assembly can be set in a sub-sill pan which can be fabricated to meet the drainage requirements of the project installation, and designed to direct water away from the sill assembly. A weep slot can be cut across the sill assembly to allow drainage of incidental water or moisture that enters the sill.

The panels disclosed herein can employ a bottom rail. The bottom rail of the panel can include slots for placement of weathering material, such as pile, brush, or gasket, which can reduces the amount of dust, debris, or precipitation that may enter the sill assembly.

The bottom rail can include a fin or blade. The fin or blade can be integral to the bottom rail of the panel. The fin or blade can be continuous along the bottom of the rail. The fin or blade can end or terminate at a short distance of the full width of the panel, to, for example, conceal its visibility.

The bottom rail blade can have a convex portion with a radius that is smaller than the radius of a concave portion the rollers in the cartridge. The smaller radius can reduce friction by minimizing the contact area of the roller and blade, thus allowing the panel to travel with minimum resistance, and keeping the panel centered in the sill assembly. The blade can be made as a separate part and integrated into the bottom rail assembly for purposes of reducing thermal conductivity through the door panel and/or strengthening or otherwise improving the performance of the rail assembly. The blade can be reinforced using a formed cap which is applied to the blade. The blade can be a separate part with a formed cap.

Systems disclosed herein are at least partially disposed below the flooring surface and concealed from view such that the presence of the sliding door assembly is less noticeable visually. In some aspects, the moveable door or panel of the system incorporates a blade that extends from a floor-facing surface of the moveable door or panel toward the roller assembly below the floor. The blade can extend through a narrow gap on the floor and rest on the roller assemblies that are below the top surface of the floor.

A brush holder can extend from the subterranean sill toward the top floor surface. The brush holder can be adapted to hold a brush insert having bristles that extend across the gap and toward the blade. The panel system can have a brush holder disposed on either side of the gap and running along the longitudinal extent of the blade. The brush holder can reduce debris passing through the gap and fouling the roller assembly or the sill. The brush holder be removed from the sill to widen the gap and gain access to the roller assemblies.

The panel system can allow a single technician to service the rollers without requiring removal of the panel or trim. The panel system can include a staggered sill that is not exposed to the exterior when the panels are closed.

Systems disclosed herein can improve on sill assemblies that have a track for each operable panel to travel on. Such sill assemblies may support panel(s) to which, within the bottom rails of each operable panel, have a set of roller assemblies attached to the moveable sliding panel. The panel with its roller assembly attached to the bottom rail, is positioned over the track in the sill assembly, and can travel horizontally on the track. Such roller assemblies are concealed in the bottom rail of the operable panel and not visible. Thus, depending on the size and weight of the operable panel, such roller assemblies have required the use of a typically large bottom rail in the sill which could contain and support the roller assembly for a large panel.

According to this disclosure, a sliding panel system having a moveable panel for providing access to an exterior of a building structure can include one or more of the following: a frame configured to be positioned at least partially in one or more walls of the building structure, the frame comprising: a first jamb configured to be positioned vertically in the one or more walls; a second jamb configured to be installed vertically in the one or more walls, the second jamb configured to be positioned in the one or more walls opposite the first jamb; and a sill configured to be positioned horizontally in a floor of the building structure, the sill configured to be flush with an upper surface of the floor, the sill configured to horizontally extend in a longitudinal direction between the first and second jambs; a roller assembly configured to be secured in the sill, the roller assembly configured to be in the sill below the upper surface of the floor, the roller assembly comprising: an outer housing configured to be positioned in the sill below the upper surface of the floor, the outer housing comprising a socket and a stop protrusion; an inner housing at least partially positioned within the outer housing, the inner housing comprising a boss positioned within the socket of the outer housing, the boss configured to move within the socket such that the inner housing moves about the boss relative to the outer housing, wherein the stop protrusion of the outer housing is configured to contact a surface of the inner housing to limit movement of the inner housing relative to the outer housing; a first roller positioned at least partially in the inner housing, the first roller configured to rotate about a first axis that is transverse to the longitudinal direction; and a second roller positioned at least partially in the inner housing, the second roller positioned along the longitudinal direction from the first roller, the second roller configured to rotate about a second axis that is transverse to the longitudinal direction; a moveable panel assembly configured to be installed over the sill and extend between the first and second jambs in the longitudinal direction, the moveable panel assembly configured to move in the longitudinal direction between the first and second jambs to provide access to the exterior from the building structure, the moveable panel comprising: a panel separating the exterior from the building structure; a bottom support rail configured to support the panel vertically, the bottom support rail configured to be positioned over the roller assembly, the bottom support rail comprising a bottom rail surface configured to face the sill; and a support blade extending from the bottom support rail perpendicular to the bottom rail surface of the bottom support rail, the support blade comprising a radial surface configured to contact at least one of the first roller or the second roller to move in the longitudinal direction with the first roller configured to rotate about the first axis or the second roller configured to rotate about the second axis, wherein in a first position of the moveable panel along the longitudinal direction, the radial surface of the support blade is configured to contact the first roller to cause the inner housing to move relative to the outer housing such that the first roller is vertically lower than the second roller, and wherein in a second position of the moveable panel along the longitudinal direction, the radial surface of the support blade is configured to contact the first roller and the second roller to cause the inner housing to move relative to the outer housing such the first roller is substantially level with the second roller along the longitudinal direction.

In some embodiments, the sliding panel system can further include one or more of the following: wherein in a third position of the moveable panel along the longitudinal direction, the radial surface of the support blade is configured to contact the second roller to cause the inner housing to move relative to the outer housing such that the second roller is vertically lower than the first roller; wherein the inner housing is configured to rotate substantially about the boss within the socket up to a predetermined angle relative to the outer housing; wherein the predetermined angle ranges from 1 to 5 degrees; wherein the support blade extends along a width of the bottom support rail; wherein a length of the support blade extends the width of the bottom support rail; wherein the bottom support rail and the support blade are formed from a monolithic piece of material; further comprising a seal configured to contact the upper surface of the floor, wherein the bottom support rail comprises a slot, the slot configured to engage the seal, the seal extending from the slot and from the bottom rail surface of the bottom support rail; further comprising a non-moveable panel configured to be stationary in another sill, the non-moveable panel comprising another bottom rail, the other bottom rail comprising another support blade configured to extend into the other sill to support the non-moveable panel; and further comprising a fixed panel support configured to be positioned in the other sill, the fixed panel support comprising a support surface corresponding to another radial surface of the other support blade, the other support surface configured to contact the other radial surface to support the non-moveable panel relative to the other sill.

According to this disclosure, a sliding panel system can include one or more of the following: a sill extending along a longitudinal direction; a roller assembly configured to be attached to the sill and comprising a roller adapted to rotate about an axis that is oriented transverse to the longitudinal direction; and a moveable panel comprising a blade, the blade configured to be resting on the roller such that the roller is configured to rotate about the axis as the moveable panel moves along the longitudinal direction.

In some embodiments, the sliding panel system can further include one or more of the following: wherein the roller is disposed beneath a top surface of a floor; further comprising a brush holder adapted to attach to the sill; further comprising a brush insert sized to fit within the brush holder; wherein the brush holder comprises a keyed feature adapted to interlock with a corresponding feature of the sill; wherein the keyed feature can be non-destructively decoupled form the corresponding feature by pulling the brush holder away from the sill; wherein the roller assembly comprises a second roller aligned in tandem with the roller; wherein the sill comprises a staggered sill, the staggered sill having a longitudinal length less than a longitudinal length of the sliding panel system; further comprising a weep slot cutout in a bottom surface of the sill; and wherein the blade rests on a concave surface of the roller.

According to this disclosure, a sliding panel assembly can include one or more of the following: a panel separating the exterior from the building structure; a support rail configured to support the panel vertically, the support rail configured to be positioned over a roller assembly positioned in a sill, the support rail comprising a rail surface configured to face the sill; and a support flange securely connected to the rail surface and extending from the support rail perpendicular to the rail surface, the support flange comprising a radial surface configured to contact the roller assembly for the support blade to move in a longitudinal direction, wherein the support flange is configured to extend downwardly from the rail surface into the sill.

In some embodiments, the sliding panel assembly can further include one or more of the following: wherein the support flange extends along a width of the support rail; wherein a length of the support flange extends the width of the support rail; and wherein the support rail and the support flange are formed from a monolithic piece of material.

According to this disclosure, a method of manufacturing a sliding panel assembly for providing access to an exterior of a building structure can include one or more of the following: attaching a panel to a support rail using a seal applied between the panel and support rail, the panel configured to separate the exterior from the building structure, the support rail configured to support the panel vertically, the support rail configured to be positioned over a roller assembly positioned in a sill, the support rail comprising a bottom rail surface configured to face the sill; and attaching or forming a support blade connected to the bottom rail surface and extending from the support rail perpendicular to the bottom rail surface of the support rail, the support blade comprising a radial surface configured to contact the roller assembly for the support blade to move in a longitudinal direction on the roller assembly, the support blade configured to extend downwardly from the bottom rail surface into the sill.

In some embodiments, the method can further include one or more of the following: further comprising extending the support blade along a width of the support rail; further comprising extending a length of the support blade to be substantially equal to the width of the support rail; and further comprising forming the support rail and the support blade from a monolithic piece of material Methods of using the foregoing system(s) (including device(s), apparatus(es), assembly(ies), structure(s), and/or the like) are included; the methods of use can include using or assembling any one or more of the features disclosed herein to achieve functions and/or features of the system(s) as discussed in this disclosure. Methods of manufacturing the foregoing system(s) are included; the methods of manufacture can include providing, making, connecting, assembling, and/or installing any one or more of the features of the system(s) disclosed herein to achieve functions and/or features of the system(s) as discussed in this disclosure.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

A sliding door or panel can be mounted on a track that runs across the top of a doorway and can additionally or alternatively be mounted on top of a track that runs along the floor. As discussed, sliding doors and panels can allow an architectural space to be reconfigured by moving the sliding doors or panels as desired. The tracks that support the sliding door or panel can interfere with the aesthetic look of the architectural space in which the sliding door or panel is installed. For example, a sliding door or panel can be configured to separate an interior room from an exterior space when the sliding door or panel is closed. The sliding door or panel can be opened to create a feeling of connection between the interior room and the exterior space. A track running along the floor at the border between the interior room and the exterior space can visually interrupt or diminish the feeling of connection between the interior room and the exterior space that is desired by opening the sliding door or panel. In some aspects, the systems and assemblies disclosed herein provide a visually-discreet track system that is at least partially hidden from view when the sliding door or panel is open.

In some aspects, the systems disclosed herein work on a principle of a reversed rolling assembly in which the track is integrated into the bottom rail of the door or panel as a blade or rail-like structure. The blade can move along rollers that are fixed to a sill member that is embedded in the floor. In some aspects, the systems of the present disclosure have doors or panels that can be placed and removed by simply lifting the door or panel out of the frame without removing any trim or other frame members. In some aspects, the rollers of the panel systems are individually serviceable by a single technician without removal of the sliding door or panel, as described herein.

Figure 1:
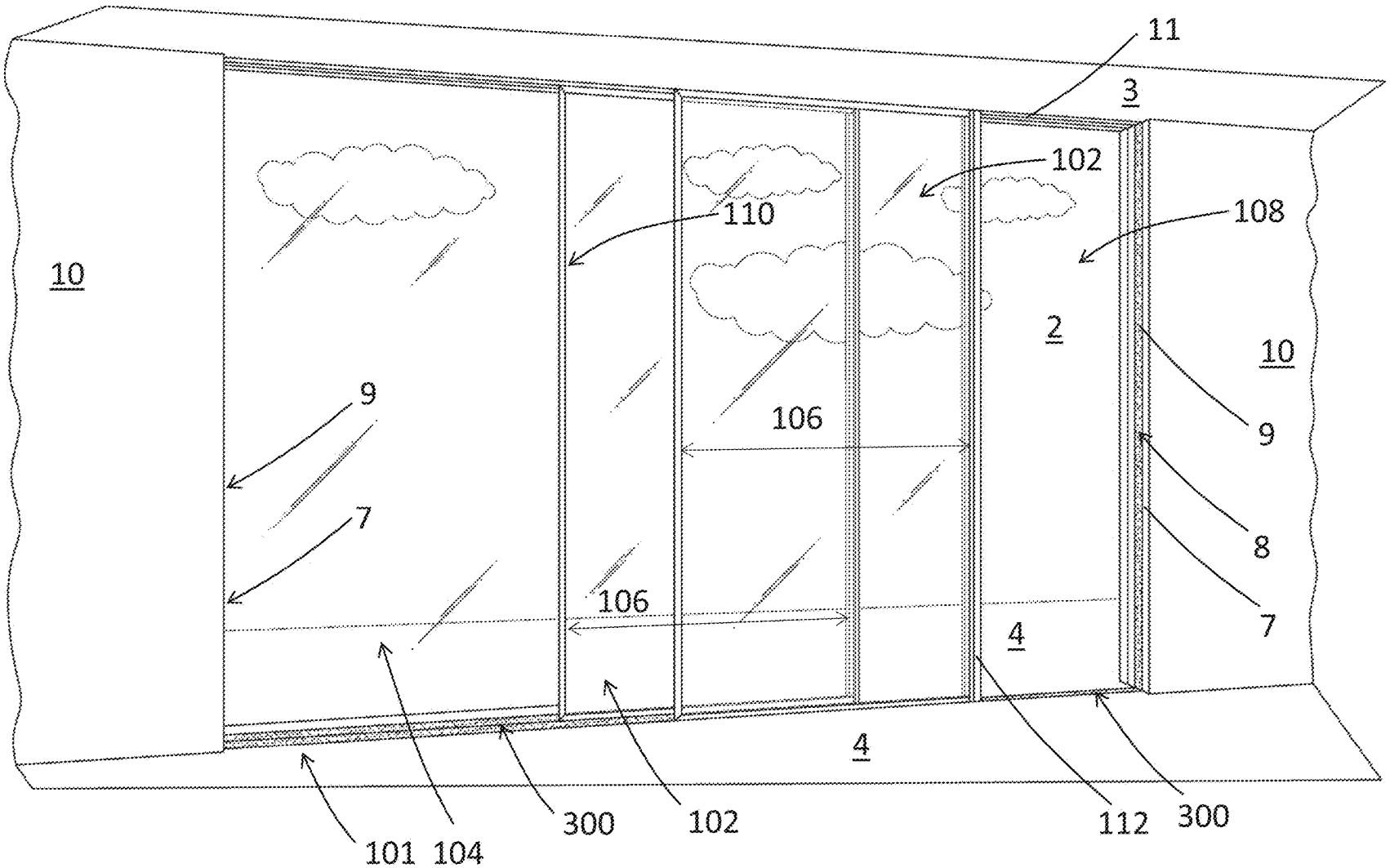
FIG. 1 is an illustrative embodiment of an installed panel system.

FIG. 1 illustrates an embodiment of a panel system 100 installed into a frame 7 in a wall 10. The frame 7 can be installed in the wall 10 of a building structure to support the panel system 100 as discussed herein. The panel system 100 can separate an exterior space 2 (ambient environment of building structure) from an interior space 3 of a building structure having the wall 10. The panel system 100 can have a sill assembly 101 for supporting sliding glass doors or panels installed in a frame 7. The frame 7 can define the assembly within which the panels are placed and operate.

As illustrated in FIG. 1, an opening 108 can be formed between a free edge 110 of a non-movable panel 104 and a wall 10. In some embodiments, a moveable panel 102 can open along the roller assemblies as discussed herein to such that an extent of the opening 108 corresponds or is substantially a width 106 of one or more moveable panels 102. The width 106 can correspond to and substantially extend along a longitudinal axis or direction of movement of the one or more moveable panels 102 and/or a longitudinal extent (e.g., a width or length) of one or more sill 300.

In the illustrated embodiment, the one or more moveable panel or moveable panel assembly 102 is in the partially open or a partially closed position, with the one or more moveable panel 102 blocking or sealing the opening 108 a fully closed position. In some embodiments, the term panel may refer to a panel assembly including a bottom rail and a panel or panel material such as glass as discussed herein. As shown, a moveable panel 102 can have a lead edge 112 that sits within a recess 8 of the wall 10 when the movable panel 102 is in the closed position or configuration. In the closed configuration, the moveable panel 102 can extend entirely across the opening 108 such that the moveable panel 102 and the non-moveable panel or non-moveable panel assembly 104 form a unitary wall or barrier that blocks passage across the panel system 100 to the exterior 2. The moveable panel 102 can be moved from the closed configuration to the open configuration by sliding the moveable panel 102 along a roller assembly as discussed herein of the panel system 100 to position the moveable panel 102 at least partially behind the non-moveable portion 104, thereby unblocking the opening 108 such that the threshold to the exterior 2 is open and can be crossed.

As illustrated in FIG. 1, the frame 7 can have two opposing vertical jamb assemblies 9, a horizontal head assembly 11 which runs between the jamb assemblies 9 and across the top of the frame 7, and a sill assembly 101 having one or more sills 300 which runs along the floor 4 of the building structure between the jamb assemblies 9 at the bottom of the frame 7. The sill assembly 101 can be set into and be flush with the surrounding flooring 4, such as the interior flooring and/or exterior flooring in which the sill assembly 101 is mounted. For example, the sill assembly 101 can be flush with the interior floor on the inward side of the sill assembly 101 (e.g., the interior 3 of the opening 108) and/or the exterior floor on the outward side of the sill assembly 101 (e.g., the exterior 2 of the opening 108) such that the interior floor and the exterior floor appear from afar as one continuous planar surface when the moveable panel is in the open configuration.

In some embodiments, the panel system 100 can have more than one moveable panel. For example, as illustrated in FIG. 1, the panel system can have a two moveable panels 102 as well as one non-moveable panel 104. Accordingly, the opening 108 can correspond to or be substantially two widths 106 of the moveable panels 104 with the two moveable panels 102 in the open position.

Figure 2:
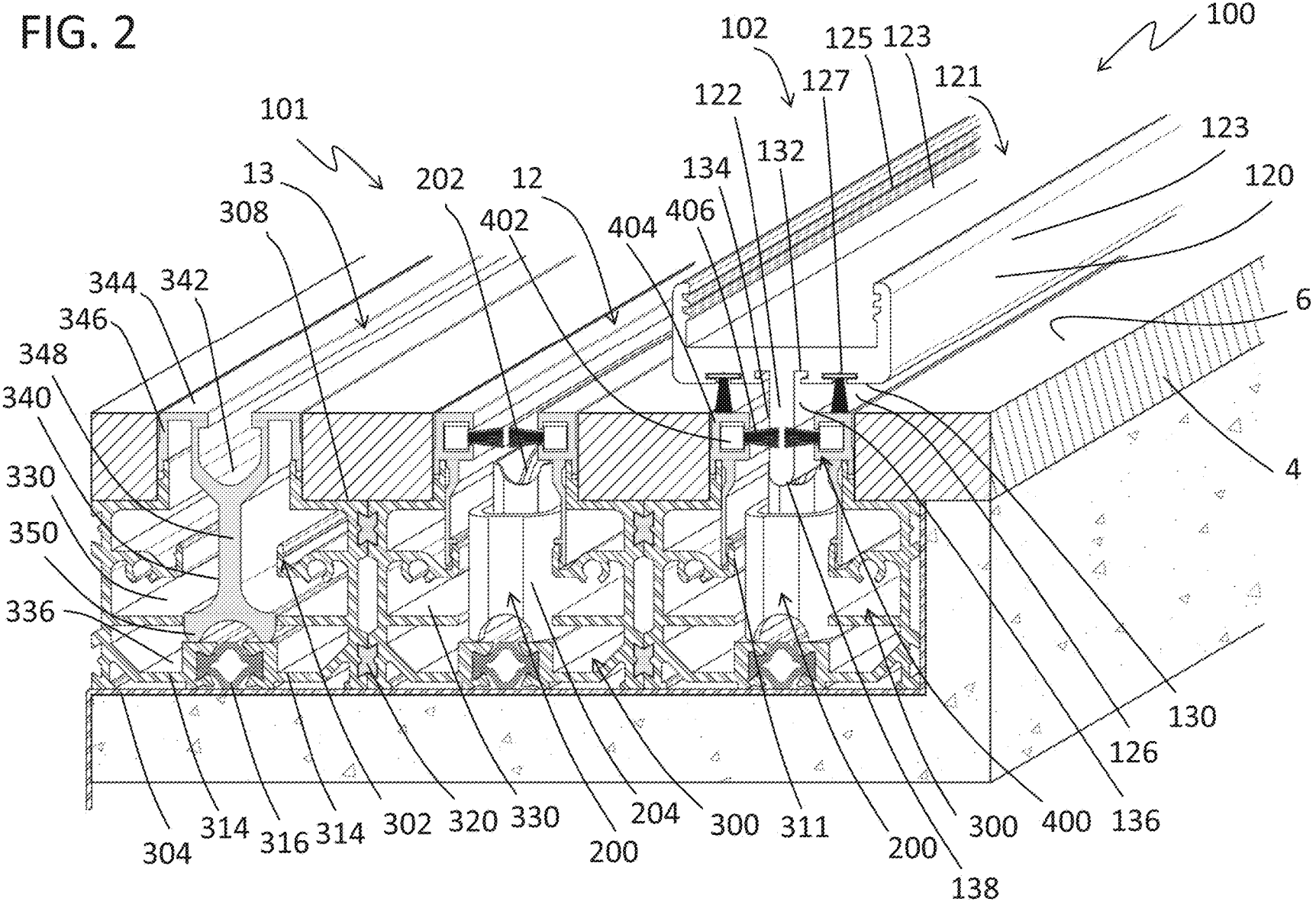
FIG. 2 is a cross-sectional isometric view of an embodiment of a panel system.
Figure 3:
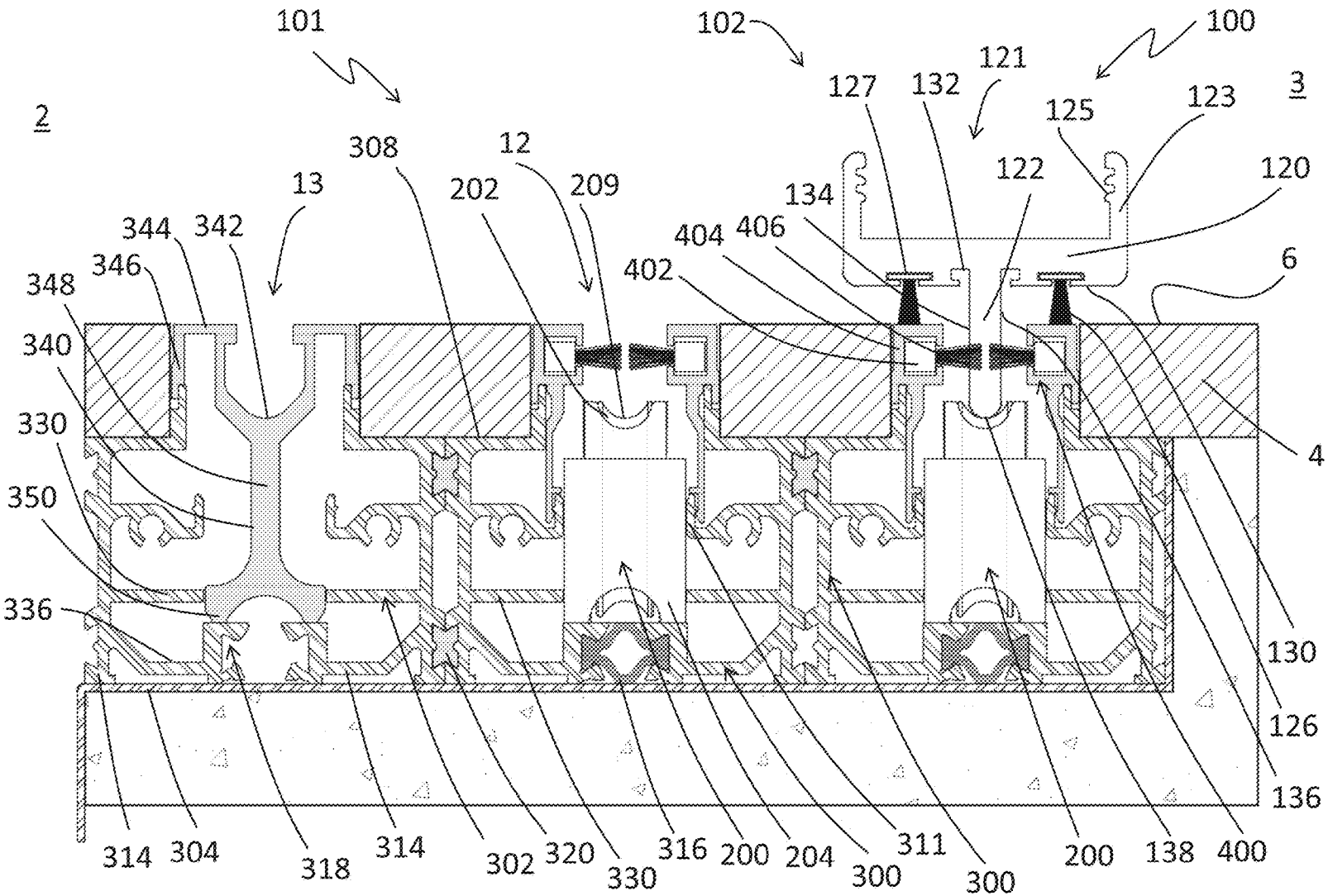
FIG. 3 is a cross-sectional end view of an embodiment of a panel system.
Figure 4:
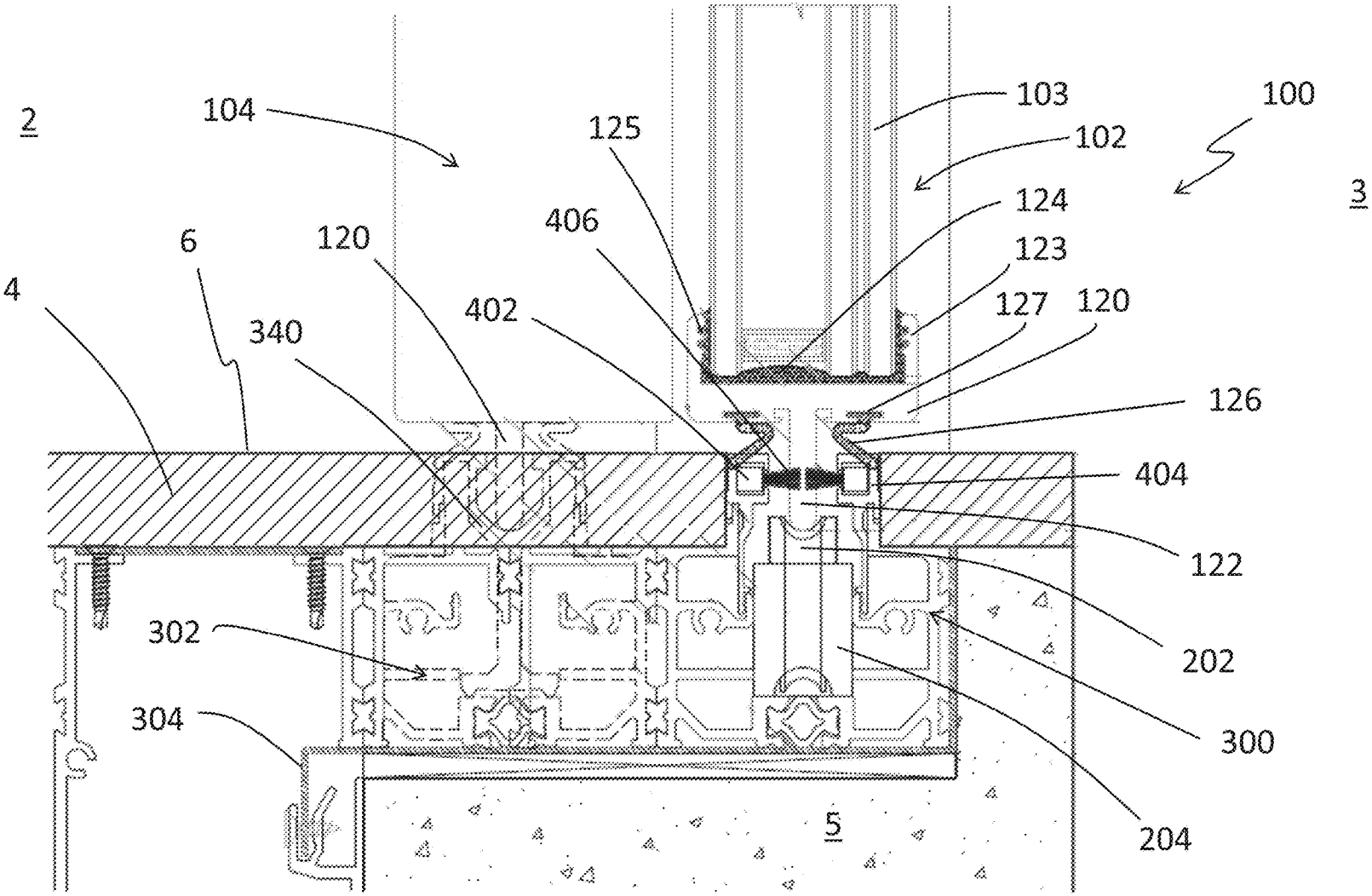
FIG. 4 is a cross-sectional end view of an embodiment of a panel system.

FIGS. 2, 3, and 4 show a non-limiting, illustrative embodiment of a panel system 100. The panel system 100 can include a moveable panel 102 and a non-moveable panel 104. In the illustrated embodiment, the moveable panel 102 and the non-moveable panel 104 can be double-paned glass panels. In some aspects, one or each of the moveable panel 102 and the non-moveable panel 104 can be a single-paned glass panel or a panel made of other material (e.g., wood, translucent plastic, etc.). The panel system 100 can include one or more than one movable panels 102, and one or more than one non-moveable panels 104, as described herein.

Referring to FIGS. 2 and 3, the sill assembly 101 can have three sills or bases 300, 302 with slots or gaps 12 for three panels 102, 104 (see also FIG. 4). The illustrated sill assembly 101 shown in FIGS. 2 and 3 can support two operable or moveable panels 102 on sills 300 and a non-moveable (fixed) panel 104 on sill 302. The non-moveable panel 104 can be positioned and fixed relative to the sill 302 via a fixed panel support 340.

The fixed panel support 340 can have a corresponding concave support surface forming a groove or channel 342 to support blade 122 or any other suitable structure of the non-moveable panel 104. In some embodiments, the channel 342 can be any suitable surface corresponding with the radial surface 138 of the support blade 122 as discussed herein to contact and provide load bearing support for the non-moveable panel 104 The non-moveable panel 104 can have a bottom or support rail 120 having a support blade 122 as discussed herein, for example, for the moveable panel 102. The length or width of the support blade 122 can extend a width of the panel 102, 104 and/or support rail 120 along the longitudinal direction corresponding to a direction of movement of the moveable panel(s) 102.

The fixed panel support 340 can have surface wall 344 extending from the support surface 342. The surface wall 344 can extend horizontally and be substantially flush with an upper or top surface 6 of the floor 4. The two surface walls 344 of the fixed panel support 340 can form a gap 13 through which the support blade 122 of the non-moveable panel 104 is inserted to contact the support surface 342 (see FIG. 4).

The surface wall 344 of the fixed panel support 340 can be connected to a securing clip or flange 346. The flange 346 can extend vertically downward from the surface wall 344. A termination guide 328 (see FIG. 12B) of the sill 302 can support, connect with, mate with, contact, and/or position the flange 346, and correspondingly the fixed panel support 340, via any suitable mechanism, such as, for example, interference/friction fit mechanisms, snap fit mechanisms, and the like, which can include using male and female mating parts (e.g., tongue-and-groove corresponding parts).

The fixed panel support 340 can have a main body 348 that extends from or proximate the support surface 342 downward toward a bottom 336 of the sill 302. The main body 348 can split into support legs 350 that form a base of the fixed panel support 340. The legs 350 can contact any portion of the sill 302 for stability and support.

Figure 12A:
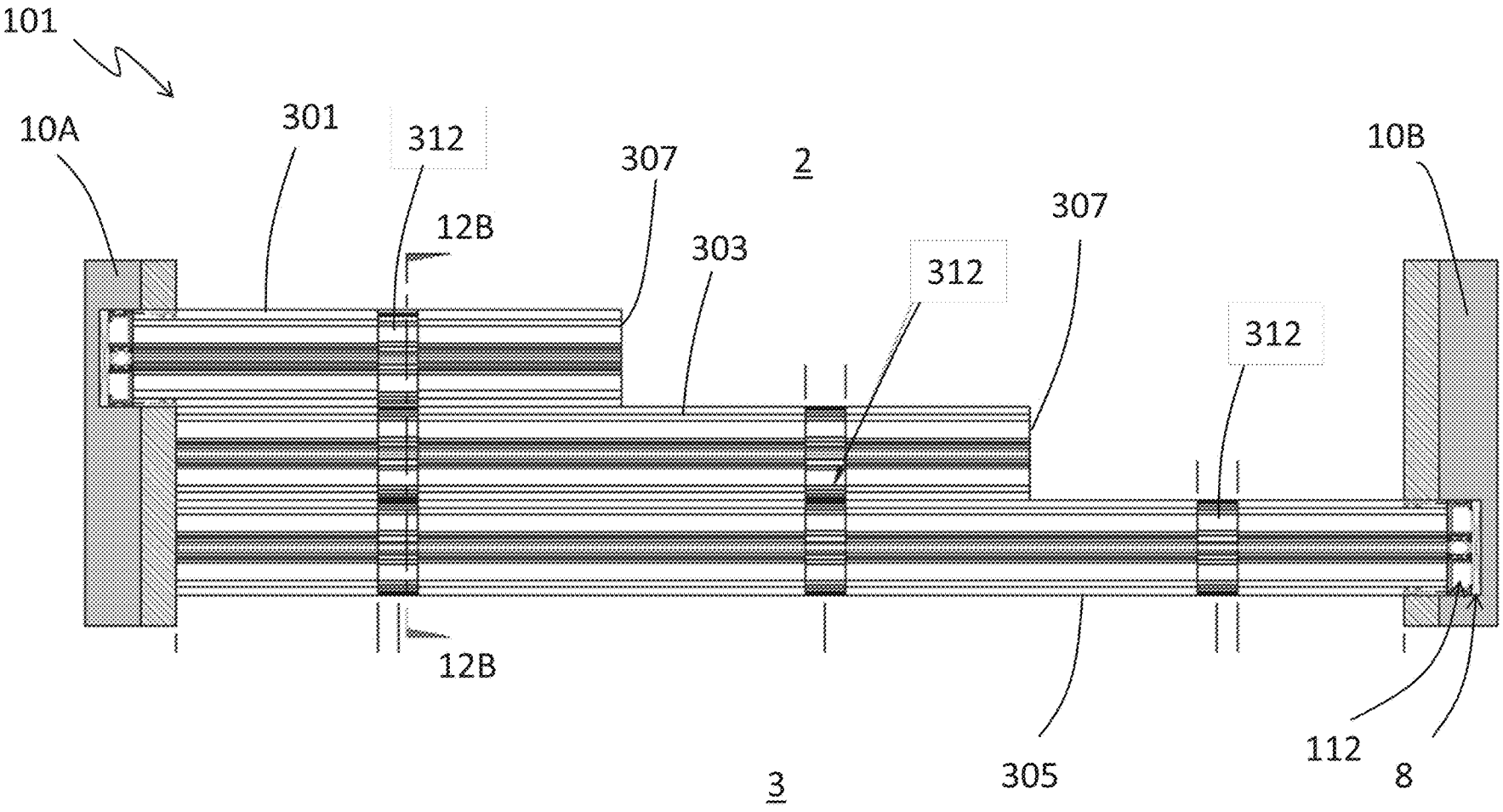
FIG. 12A is a bottom view of an embodiment of a staggered sill assembly.
Figure 12B:
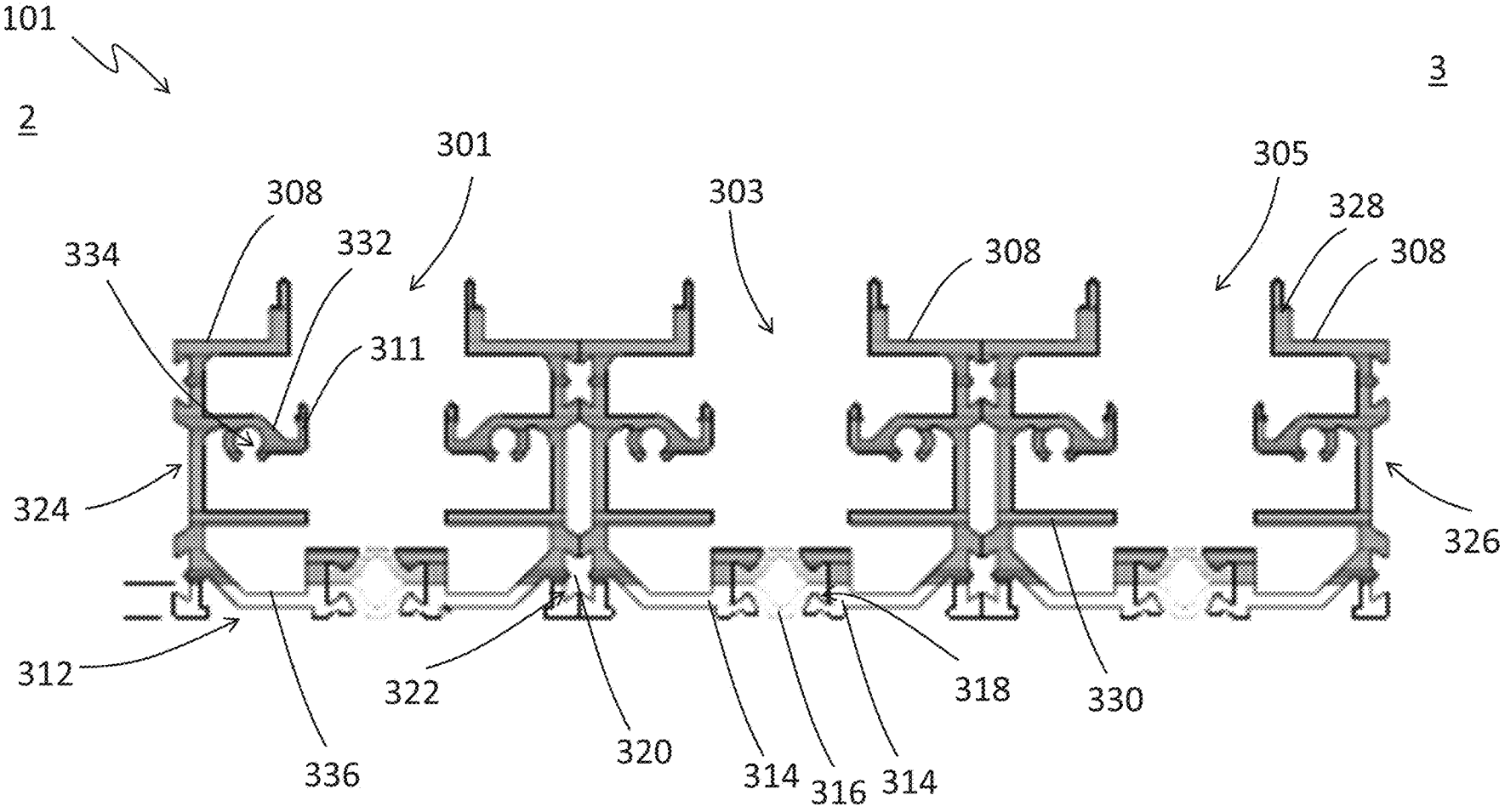
FIG. 12B is a cross-sectional end view of an embodiment of the staggered sill assembly of FIG. 12A.

As illustrated in FIGS. 2 and 3, the support legs 350 can contact and be supported by sill 302 for load bearing support of the panel 104 surfaces of the extrusion slot 318 (see FIG. 12B). In some embodiments, the legs 350 may contact and be supported by the sill 302 for load bearing support of the panel 104 via a bottom 336 or any other surface or wall of the sill 302 (see FIG. 12B). The support ledge 330 can support, connect with, mate with, contact, and/or position legs 350, and correspondingly the fixed panel support 340, via with any suitable mechanism, such as, for example, interference/friction fit mechanisms, snap fit mechanisms, and the like, which can include using male and female mating parts (e.g., tongue-and-groove corresponding parts). The one or more of the support surface 342, surface walls 344, flange 346, main body 348, and/or legs 350 can be formed from a monolithic piece of material and/or be connected via any suitable means to form the fixed panel support 340.

For illustration purposes, a single operable panel 102 is shown in FIGS. 2 and 3. While FIGS. 2 and 3 show a sill assembly 101 with three bases or sills 300, 302 for panels 102, 104, it is understood that a sill assembly may include a single base or two or more bases, as required to support one or multiple panels.

In some embodiments, one or more roller assemblies 200 can be installed below a top surface 6 of a floor 4. The roller assembly 200 can include a roller 202. The roller 202 can be rotatably mounted onto a sill 300 such that the axis of rotation of the roller 202 is substantially perpendicular to the longitudinal direction of the panel system 100. The roller 202 can spin about its axis of rotation to assist the movement of the moveable panel 102 along the longitudinal length of the panel system 100. As shown in FIGS. 2, 3, and 4, the placement of the rollers 202 and the sill 300 beneath the floor 4 can make the panel assembly 100 less noticeable visually compared to a sliding door that has rollers on the door and runs along a sill disposed at the top surface of the floor. As shown, the panel system 100 can have a narrow gap 12 at the top surface of the floor 4 to allow the blade on the bottom of the moveable panel or door to reach the subterranean rollers 202. This narrow gap 12 is less visually noticeable compared to a wider sill that is mounted on the top surface of the floor 4. The gap 12 can be about 0.5, 1, 1.5, 2, 2.5, 3, 3.5, or 4 inches.

As shown in FIGS. 2, 3, and 4, the panel system 100 can include a brush insert 400. As shown, the brush insert 400 can be disposed at or near the top surface 6 of the floor 4. The brush insert 400 can have a base portion 402 that is sized to fit within a brush holder 404. The brush insert 400 can have a brush seal 406 that extends from the base portion 402 to seal against a blade 122 of the moveable panel 102. The brush seal 406 can be adapted to reduce the amount of debris that may enter the sill 300. The brush seal 406 can be made of rigid fibers that will maintain their shape over an extended period with frequent operation of the sliding panel system 100. The rigid fibers of the brush seal 406 can be a synthetic fiber (e.g., nylon, polyester) or a natural fiber (e.g., hair). As described herein, the brush insert 400 can be removed from the brush holder 404 to allow service access to the roller assembly 200 or the sill 300. In some aspects, the brush holder 404 can be removed from the sill 300 (with or without removing the brush insert 400 from the brush holder 404) to allow service access to the roller assembly 200 or the sill 300.

FIGS. 3 and 4 shows a front cross-sectional view of the panel system 100 looking down the longitudinal length of the panel system 100. The moveable panel 102 can include a bottom rail 120 that is disposed along the roller-facing surface of the moveable panel 102. The bottom rail 120 can have or can form a channel 121 with two vertical walls 123 which run or extend the width of the panel 102, 104. The vertical walls 123 can have grooves 125 to accept a panel bonding material. As shown in FIG. 4, a wet seal 124 can seal the bottom rail 120 to glass or other material 103 of the moveable panel 102. The wet seal 124 can be made of silicone or other suitable bonding material. The panel bonding material can be adhesive, gasket, or other material which will create a firm bond between the bottom rail 120 and the panel material 103.

As shown in FIGS. 2, 3, and 4, a seal 126 can extend from the bottom rail 120 toward the brush holder 404. In the illustrated embodiment, the panel system 100 includes two seals 126 with the blade 122 disposed between the two seals 126. The bottom rail 120 can include slots 127 for placement, retention, and positioning of the seal 126. The seal 126 can be any suitable weathering material, such as foam, pile, brush, or gasket, which reduces the amount of dust, debris, water, moisture, or precipitation that may enter the sill assembly 101.

As shown in FIGS. 2, 3, and 4, a support blade, fin, or flange 122 can extend from the bottom rail 120. The blade 122 may run or extend the width of the panel 102, 104 and/or bottom rail 120. The blade 122 may terminate a short distance of the full width of the panel 102, 104, to for example, conceal the blade 122. The blade 122 can pass through a brush seal 406 and rest on the roller 202. As discussed herein, the blade 122 can move along the rollers 202 of the roller assembly 200 to facilitate movement of the moveable panel 102 along the longitudinal length or direction of the panel system 100. A roller housing 204 can be used to attach the rollers 202 to the sill 300. The panel(s) 102 with a support blade 122 can travel over the roller assemblies 200 and longitudinally along a direction of the width 106 of the sill assembly 101. The panel(s) 104 with a support blade 122 that are non-operable, non-moveable, or fixed can be set on the fixed panel support 340.

As illustrated in FIGS. 2 and 3, the blade 122 can extend substantially perpendicularly from the bottom rail 120. The blade 122 can extend substantially perpendicular to a bottom rail surface 130 of the bottom rail 120 extending a width 106 of the panel 102, 104 and facing the sill 300 and/or top surface 6 of the floor 4. The blade 122 can be integrally formed with the bottom rail 120. For example, the bottom rail 120 and the blade 122 may be formed from a monolithic piece of material. In some embodiments, the blade 122 can be formed separately from the bottom rail 120 and attached to the bottom rail 120. For example, the bottom rail may be attached using male and female mating components or may be attached via one or more fasteners including screws or nut and bolt assemblies.

As shown in FIGS. 2 and 3, the blade 122 can extend from a bottom surface 130 of the bottom rail 120. The blade 122 can extend any suitable length depending on the depth the sill 300 into which the blade 122 is configured to be used with. The blade 122 can have a length or extent into the sill 300 that is longer than the width of the blade 122 with the width of the blade 122 being perpendicular to the longitudinal direction of travel of the panel 102 along the width 106 of the panel. The bottom rail 120 may have one or more notches 132 formed in or as part of the bottom surface 130 to reduce the weight of the bottom rail 120 while allowing for a desired extent of the blade 122 into the sill 300.

As shown in FIGS. 2 and 3, the blade 122 can have a first substantially planar surface 134 and a second substantially planar surface 136 extending up to the width 106 of the panel. The surfaces 134, 136 can be substantially parallel to each other to form a straight flange 122 extending from the bottom rail 120. In some embodiments, the blade 122 may be other shapes to accommodate desired features of the blade 122 such increased load bearing. For example, the surfaces 134, 136 may extend at angle relative to each to form a trapezoidal shape that, for example, decreases in width as the blade 122 extends from the bottom rail 120. Such a shape may accommodate greater material addition to the blade 122 to increase load bearing capacity as well increase torsional strength of the blade 122 relative to the bottom rail 120.

As shown in FIGS. 2 and 3, the blade 122 can have a convex radial surface 138 corresponding to a concave radial surface 209 of the roller 202. The radius of the convex radial surface 138 may substantially correspond to the radius of the concave radial surface 209 such that the two surfaces 138, 209 are in contact to provide load bearing support as well as horizontal movement support to the blade 122 as the panels 102 are either moved in the longitudinal direction or are stationary on the roller assemblies 200.

In some embodiments, the radial surface 138 may be concave, and the radial surface 209 may be convex. In some embodiments, the surfaces 138, 209 may be substantially flat or planar. In some embodiments, the roller 202 may include one or more guiding walls or support rings that extend at the outer boundaries from the rollers 202 about a center axis of the roller 202 to guide the blade 122 within the rollers 202. In some embodiments, the blade 122 may include one or more guiding walls or protrusions that extend proximate to surfaces 134, 136 to guide the rollers 202 within the blade 122.

With continued reference to FIGS. 3 and 4, the non-movable panel 104 can be disposed between the moveable panel 102 and an exterior space 2, and the moveable panel 102 can be disposed between the non-moveable panel 104 and an interior space 3. The non-moveable panel 104 can be supported by a staggered sill 302. The staggered sill 302 can be adapted so that the staggered sill 302 is not exposed to the exterior space 2 when the panels 102, 104 are closed. The staggered sill 302 can eliminate the need for drainage. Slots can be cut into the sill 300 and the staggered sill 302 to drain incidental water, as described herein. The staggered sill 302 can be the sill 300 as discussed herein and vice versa. The panel system 100 can include a sill pan 304. The sill pan 304 can be disposed between the sill 300 and the subfloor 5, as shown.

Figure 5:
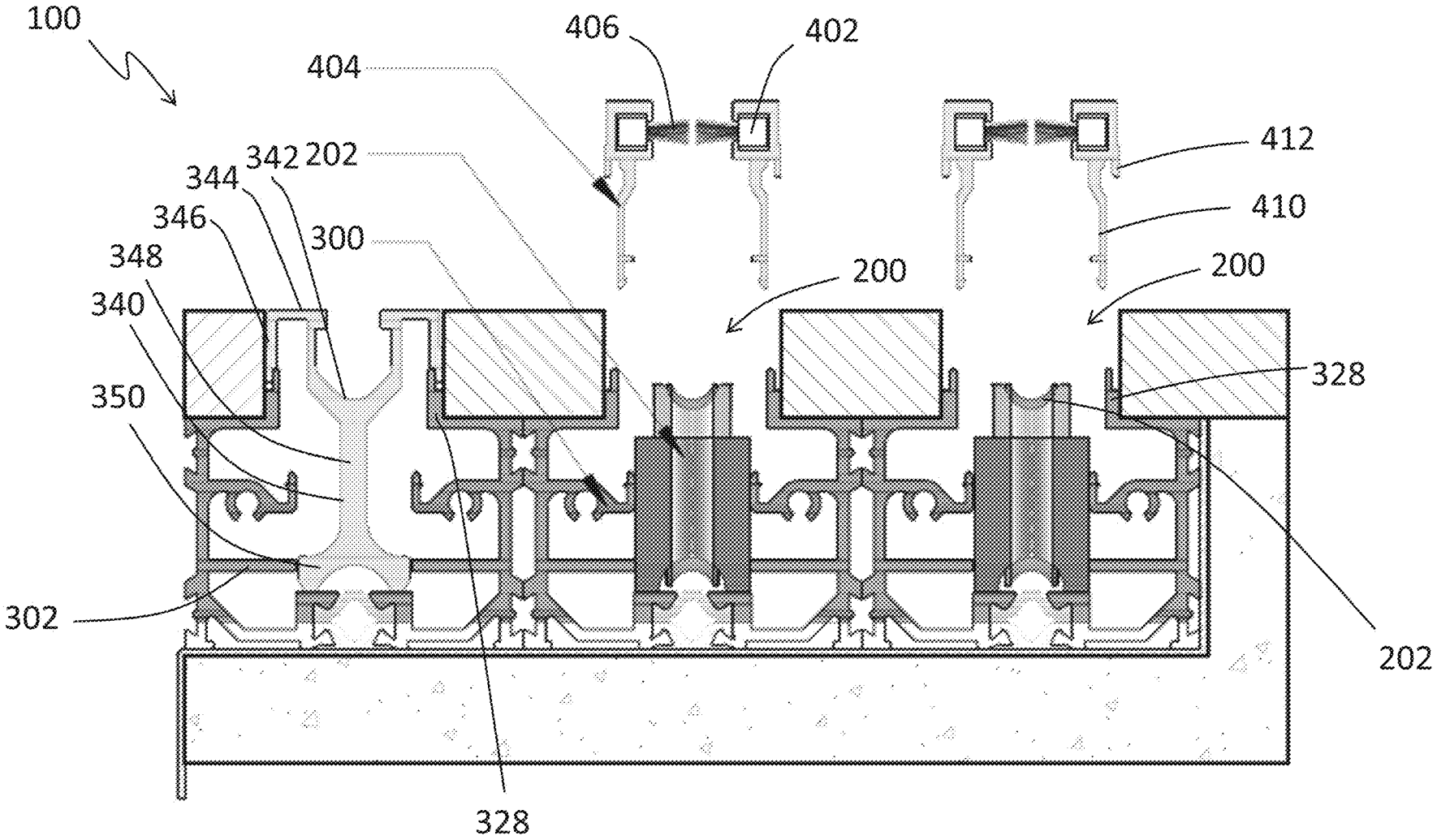
FIG. 5 is a cross-sectional end view of an embodiment of a panel system.

FIG. 5 is a front cross-sectional view of an embodiment of the panel system 100. As shown, the panel system 100 can include two or more roller assemblies 200 that run substantially parallel with one another down the longitudinal length of the panel assembly 100. In this way, the panel system 100 can have two or more moveable panels 102 that are each moveable on a separate track such that the two or more moveable panels 102 can be positioned to partially overlap with one another along the longitudinal length of the panel assembly 102. When the system 100 is in the closed configuration, the multiple panels can extend in a telescoping fashion along a staggered sill to form a unitary wall that separates the exterior space from the interior space, as described herein. In some arrangements, two or more moveable panels 102 can be installed on the same track of the panel system 100, in which case the two more moveable panels 102 can be moved relative to one another but cannot longitudinally overlap with one another because the two or more moveable panels 102 are mounted on the same track.

FIG. 5 shows that the brush holder 404 can be removed from the sill 300. Removal of the brush holder 404 from the sill 300 can allow access to the roller assembly 200. In this way, the brush holder 404 can be removed to clean or service the rollers 202 or other components of the panel system 100. The brush holder 404 can have a medial leg 410 and a lateral leg 412. The medial leg 410 and the lateral leg 412 can be flexible and allow the brush holder 404 to be deformed to fit the brush holder 404 onto the sill 300, as described herein. The brush holder 404 can be adapted to snap onto and off of the sill 300 non-destructively without the use of tools.

Figure 6:
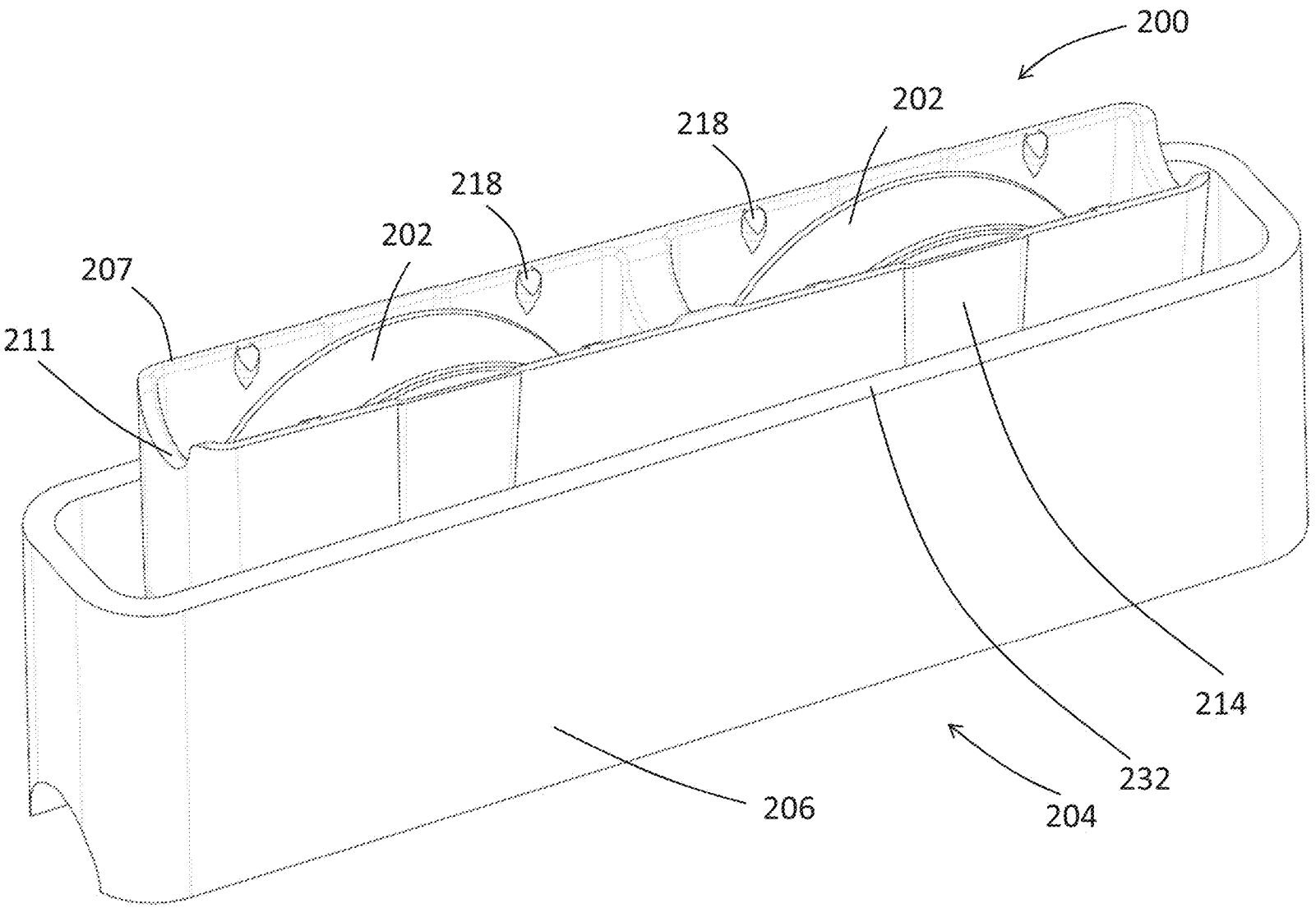
FIG. 6 is an isometric view of an embodiment of a roller assembly.
Figure 7:
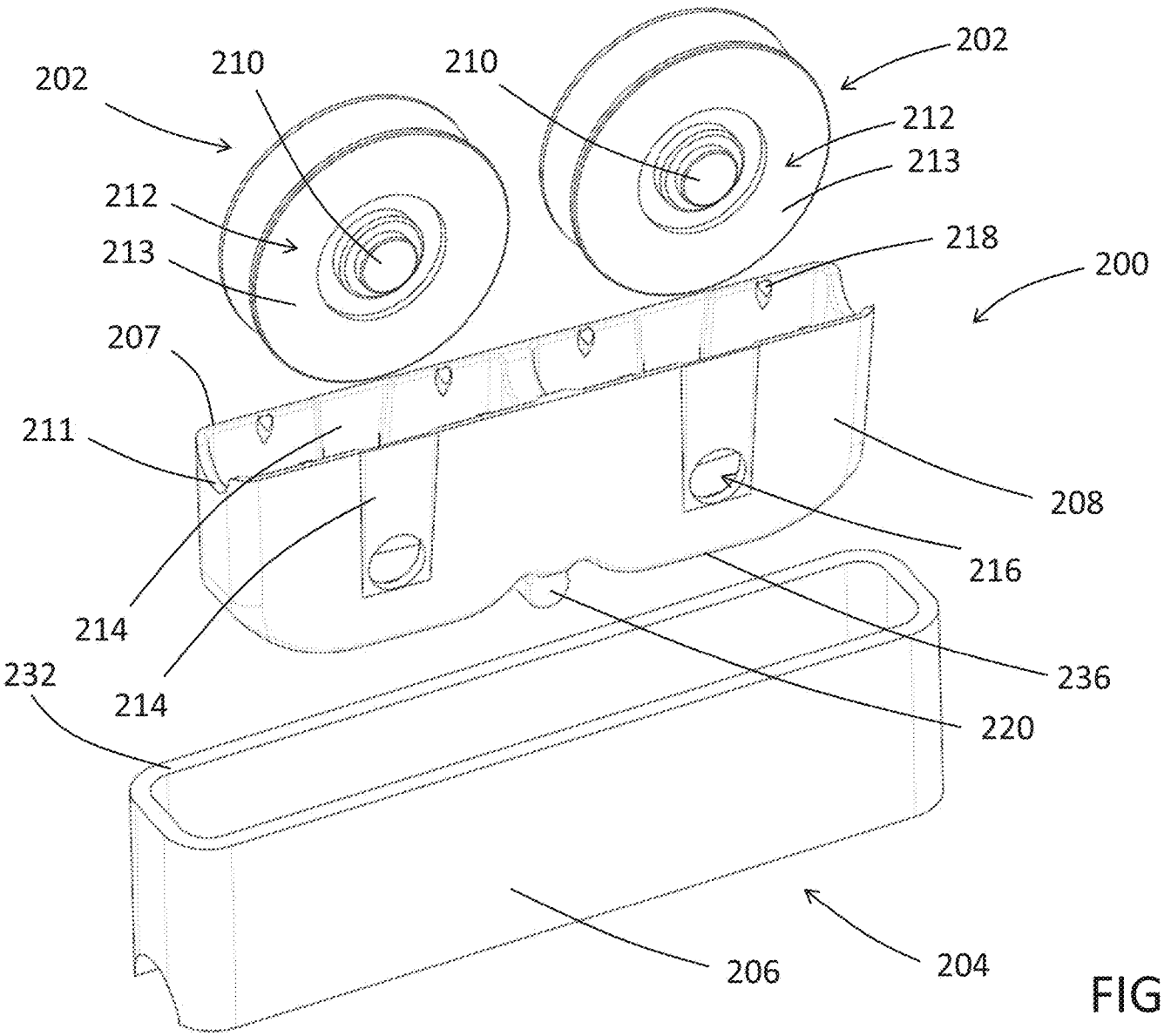
FIG. 7 is an exploded isometric view of an embodiment of a roller assembly.
Figure 8:
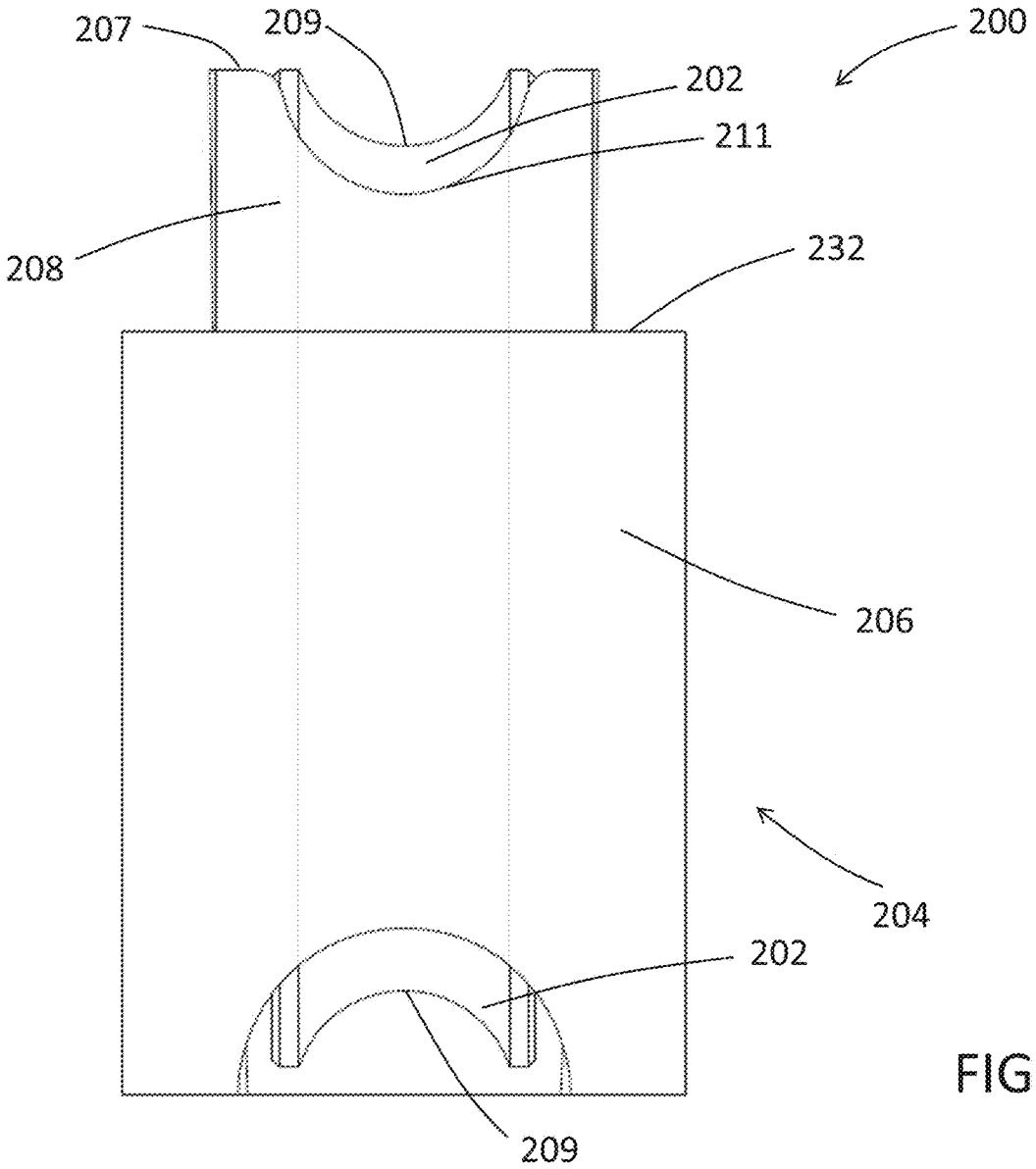
FIG. 8 is a side view of an embodiment of a roller assembly.

FIGS. 6-10 show different views of a roller assembly 200 of the panel system 100. FIG. 6 is an isometric view of the roller assembly 200. FIG. 7 is an exploded isometric view of roller assembly 200. FIG. 8 is a side view of the roller assembly 200. The roller assembly 200 can include two rollers 202 that are arranged in tandem along the longitudinal length of the panel assembly 100. In some embodiments, the roller assembly 200 can include only one roller 202. In some aspects, the roller assembly 200 can include more than two rollers 202. The system 100 can include roller assemblies 200 that have three, four, five, or more than five rollers 202 arranged in tandem. In some aspects, the number of rollers 202 or the number of roller assemblies 200 can be adapted to accommodate the weight and size of the moveable panel 102. For example, for a heavier or larger movable panel 102, the system can include more roller assemblies 200 or more rollers 202 in each of the roller assemblies 200.

The rollers 202 can be housed within a roller housing 204. The roller housing 204 can have an outer housing portion 206. The outer housing portion 206 can be adapted to snugly attach the roller assembly 200 to the sill 300 to reduce lateral movement of the rollers 202, as discussed herein. The roller housing 204 can include an inner housing portion 208 that is circumferentially surrounded by the outer housing portion 206. The inner housing portion 208 can vertically protrude upwards from the outer housing portion 206 to, for example, accommodate the blade 122 away from the outer housing portion 206. The inner housing portion 208 can be adapted to connect the rollers 202 to the outer housing portion 206 or to the sill 300. In some aspects, the inner housing portion 208 can be decoupled from the outer housing portion 206. The inner housing portion 208 can be removed from the outer housing portion 206 while leaving the outer housing portion 206 attached to the sill 300. The inner housing portion 208 can be removed from the outer housing portion 206 to facilitate service of the rollers 202.

Figure 9A:
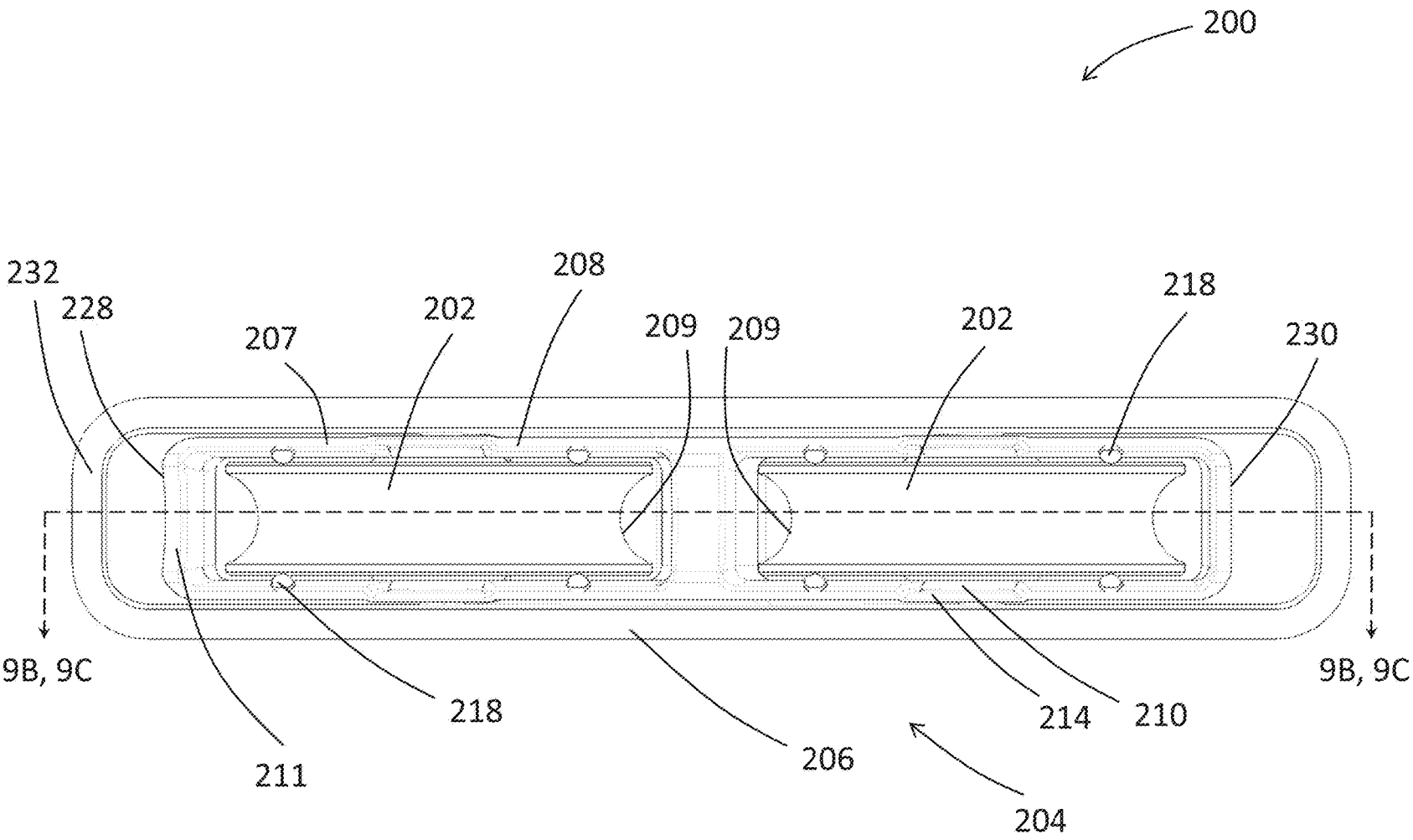
FIG. 9A is a top view of an embodiment of a roller assembly.
Figure 10:
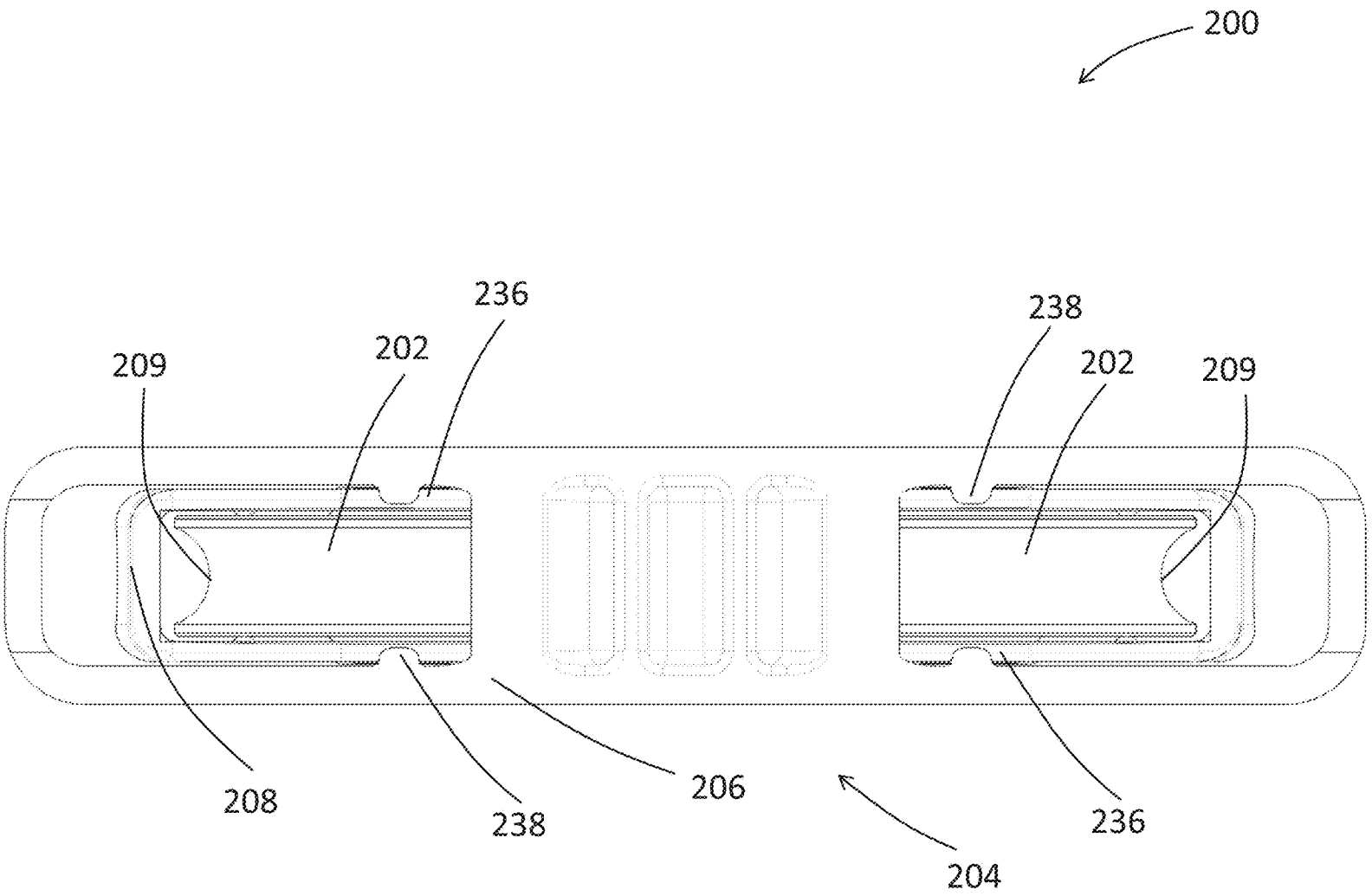
FIG. 10 is a bottom view of an embodiment of a roller assembly.

FIG. 8 is a side view of the roller assembly 200. FIG. 9A shows a top view of the roller assembly, and FIG. 10 shows a bottom view of the roller assembly 200. In the illustrated embodiment, at least a portion of the roller 202 is recessed relative to the rail-facing surface 207 of the inner housing portion 208. In some embodiments, the roller 202 can be flush with or extend beyond the rail-facing surface 207 of the inner housing portion 208.

As illustrated in FIG. 8, the roller 202 can have a blade-receiving surface 209 that supports the blade 122 of the moveable panel 102. In the illustrated embodiment, the blade-receiving surface 209 is concave. The blade-receiving surface 209 is recessed relative to the rail-facing surface 207. The inner housing 208 can have a radial cutout or indentation 211 that has a radius greater than the radial surface 138 to allow the blade 122 to pass through the inner housing 108 along the blade-receiving surface 209 that is recessed relative to the rail-facing surface 207. The concave blade-receiving surface 209 can be sized to closely approximate the blade 122 such that the lateral stability of the movable panel 102 is enhanced. In some embodiments, the blade receiving surface 209 can be convex to reduce friction between the roller 202 and the blade 122. Reducing friction between the roller 202 and the blade 122 can reduce the force required to move the moveable panel 102 along the longitudinal length of the panel system 100.

As illustrated in FIG. 7, the roller 202 can have an axle 210 about which a wheel 212 of the roller 202 can spin about a central axis passing through the axle 210, the central axis being perpendicular to the longitudinal extent. The axle 210 can have ends that extend past or beyond the planar surface 213 of the wheel 212 to protrude axially along the central axis past the planar surface 213 of the wheel 212. As illustrated in FIG. 9A, the two rollers 202 can be aligned in tandem along the longitudinal direction along which the panel 102 moves.

The inner housing 208 can have channels or guides 214 formed on an interior surface of the inner housing 208. The channels 214 can accept and guide the axles 210 of the roller 202 to position the rollers 202 within the inner housing 208. The inner housing 208 can have openings 216 on the interior surface of the housing, and in particular, along the channel 214. The openings 216 can be configured to engage, mate with, and/or connect with the axles 210 to position the roller 202 in a desired position relative to the inner housing 208. For example, when installing, the roller 202 can be positioned into the inner housing 208 with the axles 210 moving along the channels 214. The roller 202 can be moved into the inner housing 208 until the ends of the axles 210 protrude into the openings 216 to position and secure the roller 202 within the inner housing 208. The inner housing 208 can have flexibility and resilience such that when needed for servicing or other reasons, the roller 202 can be removed from the inner housing 208 with the inner housing 208 elastically expanding to allow the axles 210 to move out of the openings 216, along the channels 214, and out of the inner housing 208.

The inner housing 208 can have retention protrusions or knobs 218. The knobs 218 can extend inward toward the interior of the inner housing 208 to secure the roller 202 in the inner housing. For example, as shown in FIG. 9A, the knobs 218 can extend inward into the inner housing 208 past the planar surface 213 of the wheels 212. With the roller 202 installed or positioned within the inner housing 208 as discussed herein, the knobs 218 can inhibit the roller 202 from moving past the knobs 218 to retain the roller 202 in the inner housing 208. The inner housing 208 can have flexibility and resilience such that when needed for servicing or other reasons, the roller 202 can be removed from the inner housing 208 with the inner housing 208 elastically expanding to allow the knobs 218 to move outward and provide clearance or the ability for the wheels 212 to move past the knobs 218 and out of the inner housing 208.

Figure 9B:
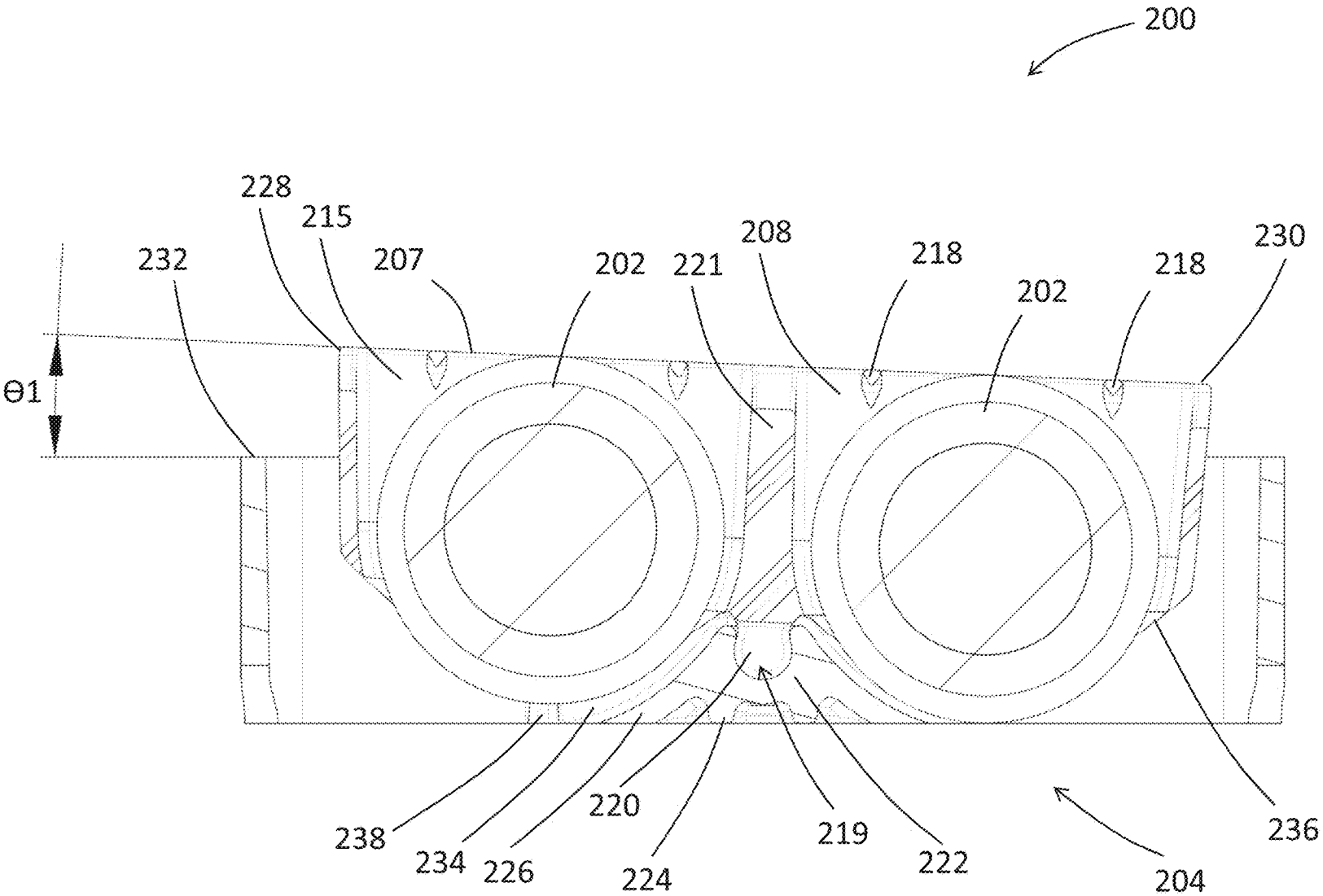
FIG. 9B is a cross-sectional view of an embodiment of the roller assembly of FIG. 9A.
Figure 9C:
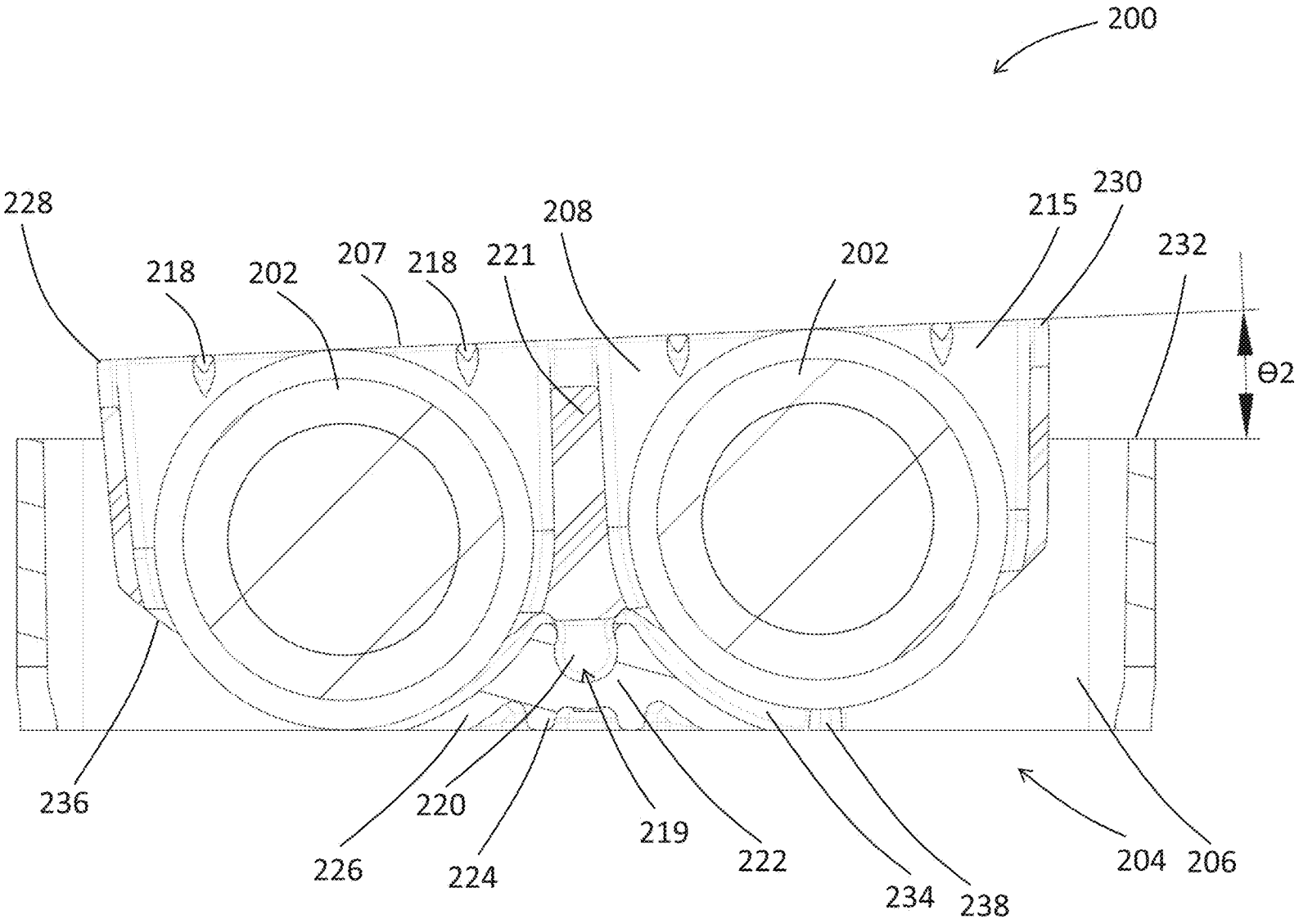
FIG. 9C is a cross-sectional view of an embodiment of the roller assembly of FIG. 9A.

FIGS. 9B and 9C show cross-section views of the roller assembly 200 along the cross-section line indicated in FIG. 9A. As illustrated in FIGS. 9B and 9C, the inner housing 208 can move relative to the outer housing about a pivot axis 219. The pivot axis 219 can be about a rotation protrusion, ball, or boss 220 (see also FIG. 7) formed as part of the inner housing 208. The boss 220 can be positioned between the roller 202 to allow one roller 202 to rock or rotate relative to another roller 202. The boss 220 can have a radial and/or convex shape or surface to allow the inner housing 208 to rotate or rock relative to the outer housing 206 as discussed herein. The inner housing 208 can have a dividing wall or arm 221 on which the boss 220 is positioned. The dividing wall 221 can support the boss 220 and separate the rollers 202 within the inner housing 208. The boss 220 can be formed integrally with the inner housing 208 and/or dividing wall 221.

As illustrated in FIGS. 9B and 9C, the outer housing 206 can have an inner housing support, depression, or socket 222. The socket 222 can have a radial and/or concave shape that corresponds to the radial surface of the boss 220. The boss 220 can be inserted into the socket 222 when the inner housing 208 is inserted into, coupled with, mated with, or joined with the outer housing 206 to allow for rotation, pivoting, or movement of the inner housing 208 relative to the outer housing 206 as discussed herein. In some embodiments, the inner housing 208 may instead have a socket 222 while the outer housing 206 may have a boss 220.

The socket 222 can have supporting structures or legs 224 that provide load bearing support to the socket 222 against a surface or wall of a sill 300. The socket 222 can have additional legs or structural walls 226 that can also provide load bearing support to the socket 222 against a surface or wall of a sill 300 as well as structural integrity to the inner housing 206.

As illustrated in FIG. 9B, with the rocking of the inner housing 208 relative to the outer housing 206, a first end 228 of the inner housing 208 can rise or elevate relative to the outer housing 206 by moving about boss 220 in contact with the outer housing 206. A first end 228 of the inner housing 208 can move a predetermined maximum rotation or movement angle θ1 about the boss 220. The predetermined maximum rotation angle θ1 can be measured from an upper surface 232 of the outer housing 206 proximate the first end 228 of the inner housing 208 to the rail-facing surface 207 of the inner housing 208. The predetermined maximum rotation angle θ1 can be about 1 degree, 1.5 degrees, 2 degrees, 2.5 degrees, 3 degrees, 3.5 degrees, 4 degrees, 4.5 degrees, or 5 or more degrees, including the foregoing values and any ranges in between. The movement of the inner housing 208 relative to the outer housing 206 will raise or elevate the roller 202 proximate to the first end 228 of the inner housing 208 relative to the roller 202 proximate to a second end 230 of the inner housing 208.

Such an orientation or elevation of the roller 202 proximate to the first end 228 can occur when the panel 102 is being initially moved onto the roller assembly 200 from the second end 230 to the first end 228. As the blade 122 of the panel 102 initially contacts the roller 202 proximate to the second end 230, the weight of the panel 102 becomes supported substantially by the roller 202 proximate the second end 230, depressing the roller 202 proximate the second end 230 with the first end 228 of the inner housing 208 rising relative to the outer housing 206 up to the predetermined maximum rotation angle θ1 (e.g., a first position of the roller assembly 200 and/or panel 102). This can allow for a smoother transition of the panel 102 onto the roller assembly 200 as the panel 102 is initially moved onto the roller assembly 200, minimizing friction as well as any jolt, jump, or otherwise resistance that may be experienced by the panel 102 as the blade 122 of the panel 102 makes initial contact with the roller 202 proximate the second end 230 while moving toward the roller 202 proximate the first end 228. By the roller 202 moving downward, the roller 202 can better accommodate the blade 122 moving onto the roller assembly 200 by the roller 202 proximate the second end 230 providing greater vertical clearance for the blade 122 to move onto the roller 202 proximate the second end 230. As the panel 102 moves onto the roller 202 proximate the first end 228, the weight of the panel 102 can become gradually more evenly distributed over both of the rollers 202. As the weight of the panel 102 becomes evenly distributed over both rollers 202, the inner housing 208 can rotate about the boss 220 to be substantially level relative to outer housing 206 in a neutral or level position (e.g., a second position of the roller assembly 200 and/or panel 102).

Similarly, such an orientation illustrated in FIG. 9B can occur when the panel 102 is being moved off the roller assembly 200 as the panel 102 moves from the first end 228 toward the second end 230. With the blade 122 of the panel 102 first moving off the roller 202 proximate the first end 228, the weight of the panel 102 will become supported substantially by the roller 202 proximate the second end 230, depressing the roller 202 proximate the second end 230 with the first end 228 of the inner housing 208 rising relative to the outer housing 206 up to the predetermined maximum rotation angle θ1 (e.g., a third position of the roller assembly 200 and/or panel 102, which can correspond to the first position of the roller assembly 200 and/or panel 102). By the roller 202 moving downward, the roller 202 can better accommodate the blade 122 moving off the roller assembly 200 by the roller 202 proximate the second end 230 providing greater vertical clearance for the blade 122 to move off the roller 202 proximate the second end 230 while minimizing any difference between the vertical extend of the 122 and the vertical clearance provided by the roller assembly 200 and in particular, the roller 202 proximate the second end 230. In some embodiments, as the panel 102 moves off the roller assembly 200 such that the weight of the panel 102 is not supported by the roller assembly 200, the inner housing 208 can rotate about the boss 220 to a neutral or level position where the inner housing 208 is substantially level relative to the outer housing 206.

As illustrated in FIG. 9C, with the rocking of the inner housing 208 relative to the outer housing 206, the second end 230 of the inner housing 208 can rise or elevate relative to the outer housing 206 by moving about boss 220 in contact with the outer housing 206. The second end 230 of the inner housing 208 can move a predetermined maximum rotation or movement angle θ2 about the boss 220. The predetermined maximum rotation angle θ2 can be measured from the upper surface 232 of the outer housing 206 proximate the second end 230 of the inner housing 208 to the rail-facing surface 207 of the inner housing 208. The predetermined maximum rotation angle θ2 can be about 1 degree, 1.5 degrees, 2 degrees, 2.5 degrees, 3 degrees, 3.5 degrees, 4 degrees, 4.5 degrees, or 5 or more degrees, including the foregoing values and any ranges in between. The movement of the inner housing 208 relative to the outer housing 206 will raise or elevate the roller 202 proximate to the second end 230 relative to the roller 202 proximate to the first end of the inner housing 208.

With reference to FIG. 9C, similar functionality and features of the roller assembly 200 can occur except with the orientation flipped. For example, as the blade 122 of the panel 102 initially contacts the roller 202 proximate to the first end 228, the weight of the panel 102 becomes supported substantially by the roller 202 proximate the first end 228, depressing the roller 202 proximate the first end 228 with the second end 230 of the inner housing 208 rising relative to the outer housing 206 up to the predetermined maximum angle θ2 to provide a smooth movement of the panel 102 onto the roller assembly 200, and in particular onto the roller 202 proximate the first end 228 (e.g., a fourth position of the roller assembly 200 and/or panel 102, which can correspond to first position of the roller assembly 200 and/or panel 102 as discussed herein). With the opposite movement of the panel 102, as the panel 102 is being moved off the roller assembly 200, the blade of 122 of the panel 102 first moves off the roller 202 proximate the second end 230, the weight of the panel 102 will become supported substantially by the roller 202 proximate the first end 228, depressing the roller 202 proximate the first end 228 with the second end 230 of the inner housing 208 rising relative to the outer housing 206 up to the predetermined maximum angle θ2 to provide a smooth movement of the panel off the roller assembly 200, and in particular off the roller 202 proximate the first end 228 (e.g., a fifth position of the roller assembly 200 and/or panel 102, which can correspond to the third position of the roller assembly 200 and/or panel 102 as discussed herein).

Similarly, such an orientation illustrated in FIG. 9B can occur when the panel 102 is being moved off the roller assembly 200 as the panel 102 moves from the first end 228 toward the second end 230. With the panel 102 first moving off the roller 202 proximate the first end 228, the weight of the panel 102 will become supported substantially by the roller 202 proximate the second end 230, depressing the roller 202 proximate the second end 230 with the first end 228 of the inner housing 208 rising relative to the outer housing 206 up to the predetermined maximum angle θ1. By the roller 202 moving downward, the roller 202 can better accommodate the blade 122 moving off the roller assembly 200 by the roller 202 proximate the second end 230 providing greater vertical clearance for the blade 122 to move off the roller 202 proximate the second end 230 while minimizing any difference between the vertical extend of the 122 and the vertical clearance provided by the roller assembly 200 and in particular, the roller 202 proximate the second end 230. In some embodiments, as the panel 102 moves off the roller assembly 200 such that the weight of the panel 102 is not supported by the roller assembly 200, the inner housing 208 can rotate about the boss 220 to a neutral or level position where the inner housing 208 is substantially level relative to the outer housing 206.

As illustrated in FIGS. 9B and 9C, the inner housing 208 may have peripheral flanges or stop walls 234 (e.g., a first stop protrusion) extending along an inner surface 215 of the inner housing 208. The flanges 234 may be connected to the structural walls 226 and extend from the structural walls 226. The flanges 234 may protrude from the inner surface 215 of the inner housing 208 a predetermined distance inward to accommodate and allow the planar surface 213 of the wheels 212 to pass along and past the flanges 234 as the inner housing 208 moves relative to the outer housing 206 as discussed herein.

The flanges 234 may extend the predetermined distance such that flanges 234 contact a lower surface, wall, or portion 236 of the inner housing 208 as the inner housing 208 moves relative to the outer housing 206 while allowing the planar surface 215 of the wheel 212 to pass by the flanges 234. For example, referring to FIG. 9B, as the inner housing 208 rotates about the boss 220, the lower surface 236 of the inner housing 208 proximate the second end 230 can come in contact with the flange 234 proximate the second end 230 to limit rotation of the inner housing 208 against the outer housing 206 at the predetermined maximum rotation angle θ1. Similarly, referring to FIG. 9C, as the inner housing 208 rotates about boss 220, the lower surface 236 of the inner housing 208 proximate first end 228 can come in contact with the flange 234 proximate the first end 228 to limit rotation of the inner housing 208 against the outer housing 206 at the predetermined maximum rotation angle θ2.

As illustrated in FIGS. 9B and 9C, the inner housing 208 may have protrusions or stops 238 (e.g., a second stop protrusion) extending along an inner surface 215 of the inner housing 208. The stops 238 may be connected to the inner surface 215 of the inner housing 208 and extend inward from the inner surface 215 of the inner housing 208. The stops 238 may protrude from the inner surface of the inner housing 208 a predetermined distance inward to accommodate and allow the planar surface 215 of the wheels 212 to pass along and past the stops 238 as the inner housing 208 moves relative to the outer housing 206 as discussed herein.

The stops 238 may extend the predetermined distance such that the stop 238 contact the lower surface, wall, or portion 236 of the inner housing 208 as the inner housing 208 moves relative to the outer housing 206 while allowing the planar surface of the wheels 212 to pass by the stop 238. For example, referring to FIG. 9B, as the inner housing 208 rotates about the boss 220, the lower surface 236 of the inner housing 208 proximate the second end 230 can come in contact with the stop 238 proximate the second end 230 to limit rotation of the inner housing 208 against the outer housing 206 at the predetermined maximum rotation angle θ1. Similarly, referring to FIG. 9C, as the inner housing 208 rotates about boss 220, the lower surface 236 of the inner housing 208 proximate first end 228 can come in contact with the stop 238 proximate the first end 228 to limit rotation of the inner housing 208 against the outer housing 206 at the predetermined maximum rotation angle θ2.

Figure 11A:
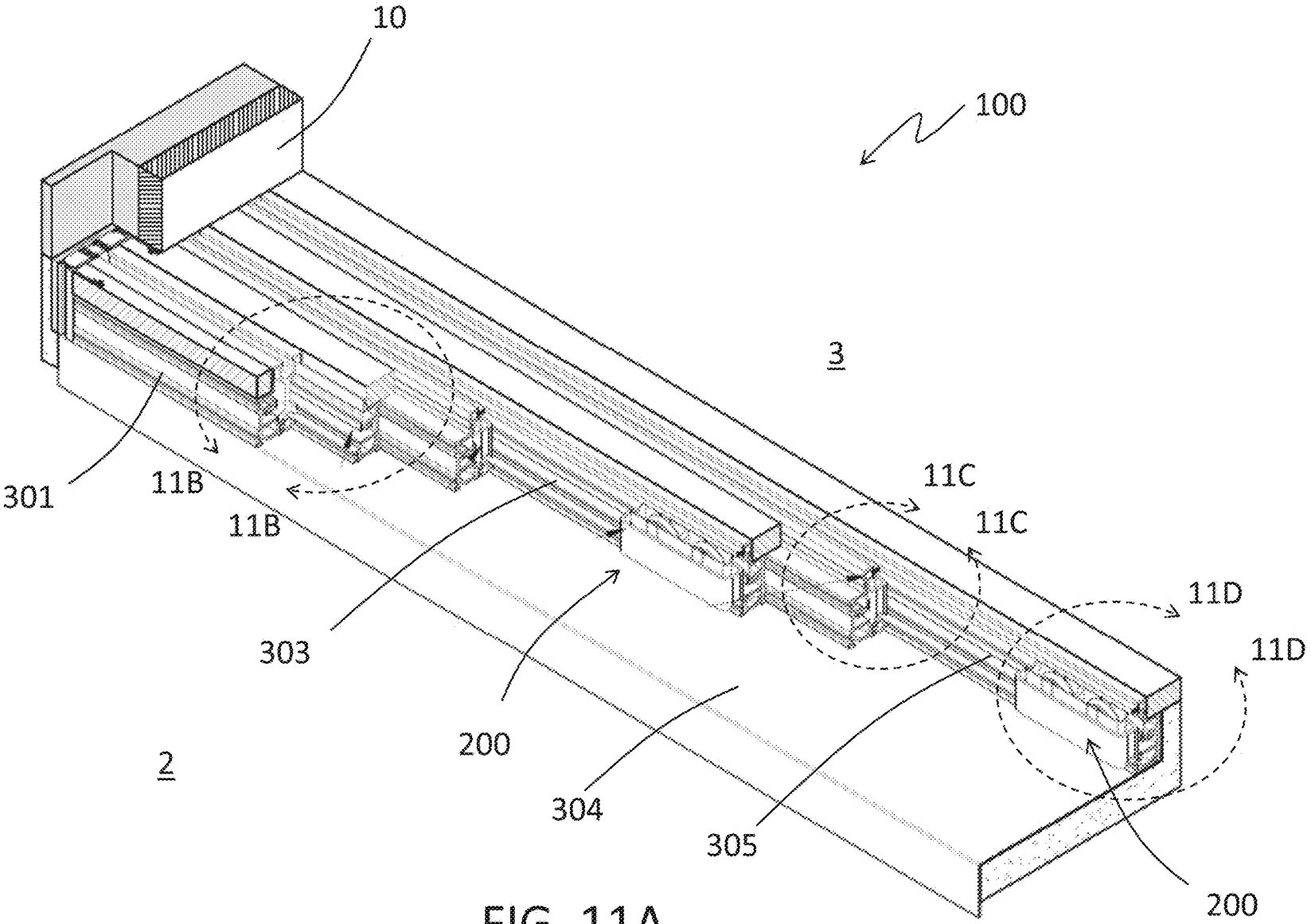
FIG. 11A is an isometric view of an embodiment of a panel system.

FIG. 11A shows an isometric view of the panel system 100. The illustrated panel system 100 is shown truncated at different places along the longitudinal length of the system 100 in order to more clearly show the components of the panel system 100. The illustrated system 100 has an exterior sill 301 that is disposed between the exterior space 2 and an intermediate sill 303. The exterior sill 301 can be a staggered sill 302. The exterior sill 301 can support a non-movable panel 104 as discussed herein. The illustrated panel system 100 also has an interior sill 305 that is disposed between the interior space 3 and the intermediate sill 303. Each of the intermediate sill 303 and the interior sill 305 can be the sill 300 as discussed herein and can support a moveable panel 102 as discussed herein. The interior sill 305 can run the full length of the threshold. The intermediate sill 303 can be a staggered sill 302 that does not run the full length of the threshold. In some embodiments, both the intermediate sill 303 and the interior sill 305 run the length of the threshold. The exterior sill 301, the intermediate sill 303, and the interior sill 305 run substantially parallel to one another along the longitudinal length of the panel system 100.

Figure 11B:
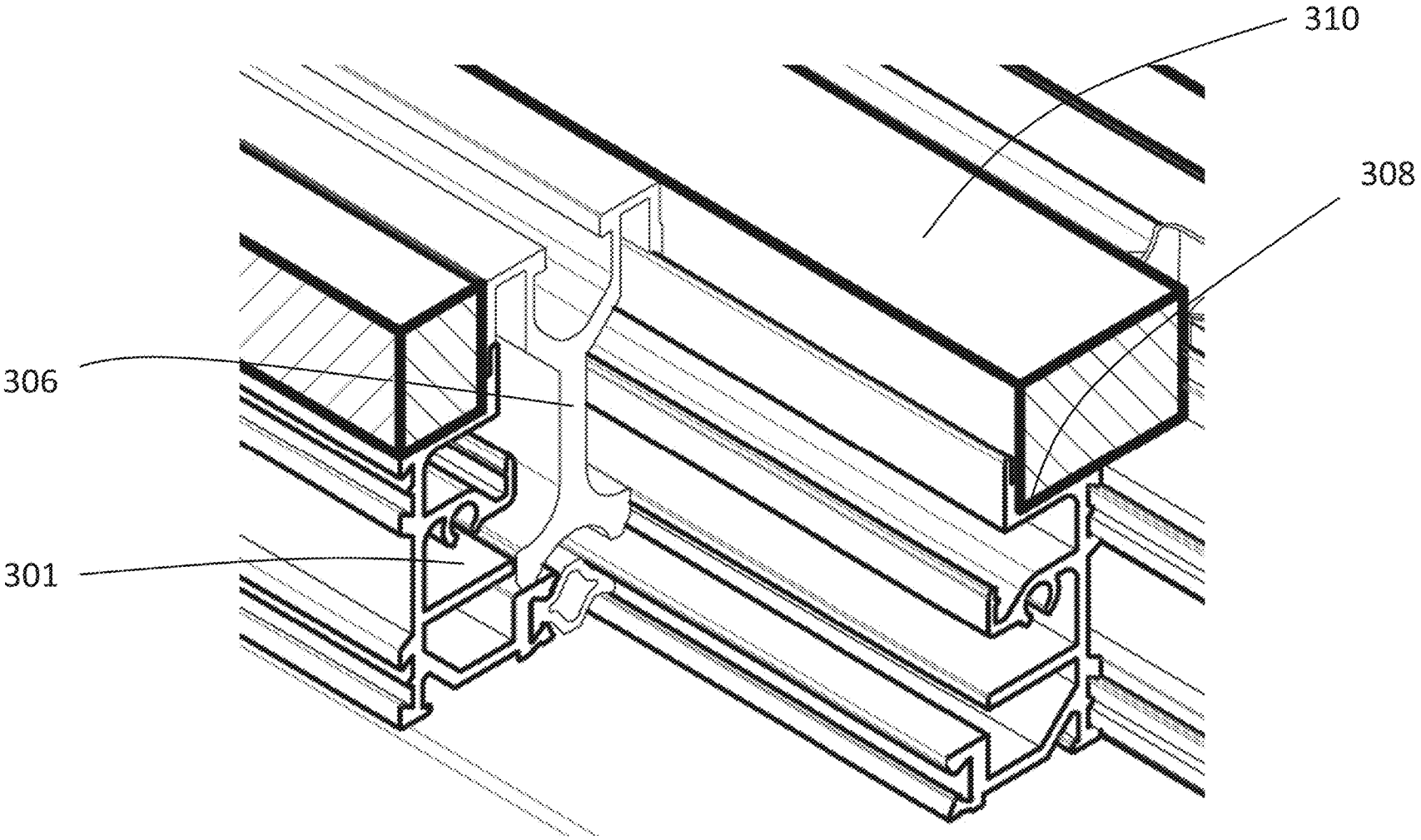
FIG. 11B is a close-up view of an embodiment of the panel system of FIG. 11A.
Figure 11C:
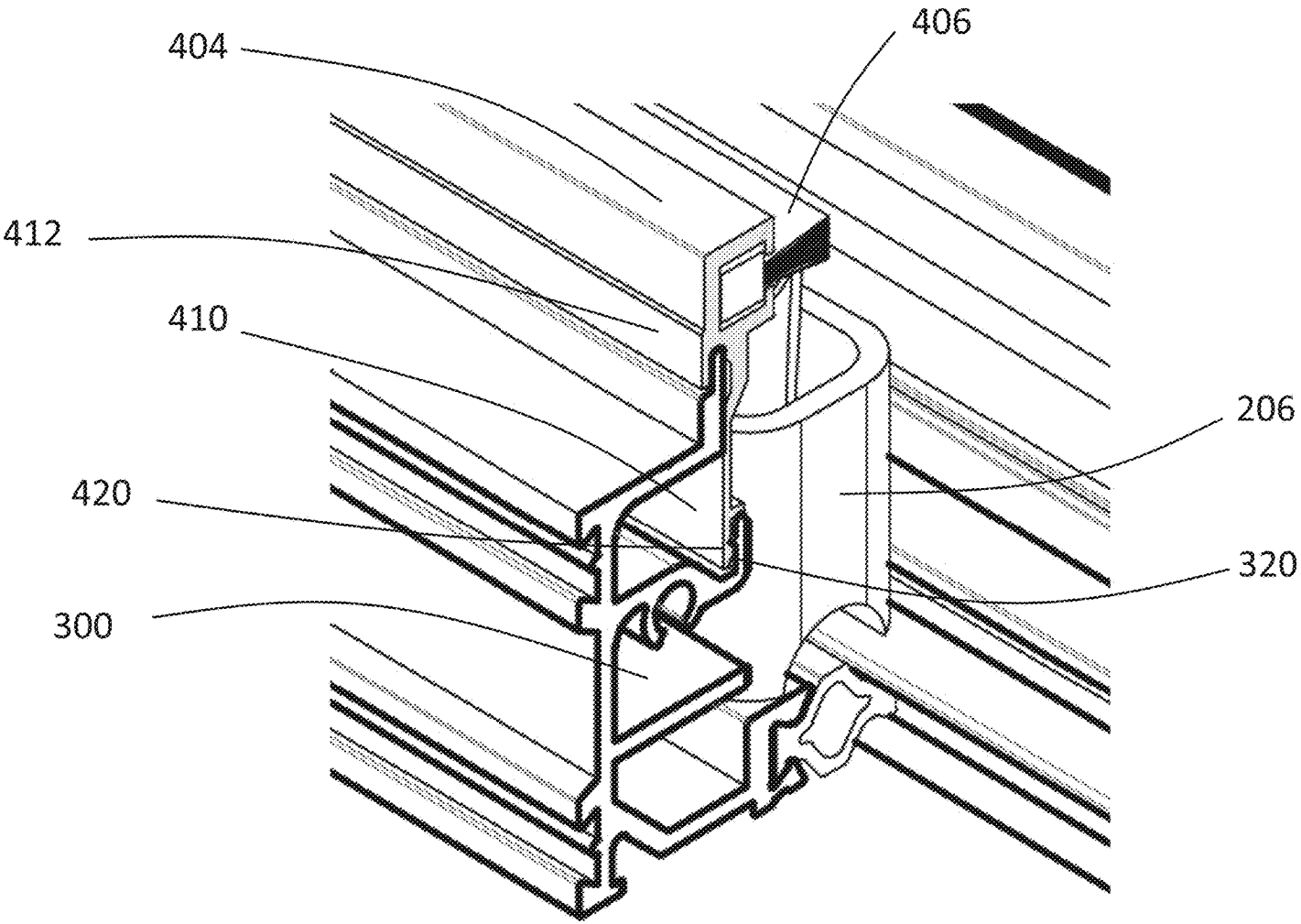
FIG. 11C is a close-up view of an embodiment of the panel system of FIG. 11A.
Figure 11D:
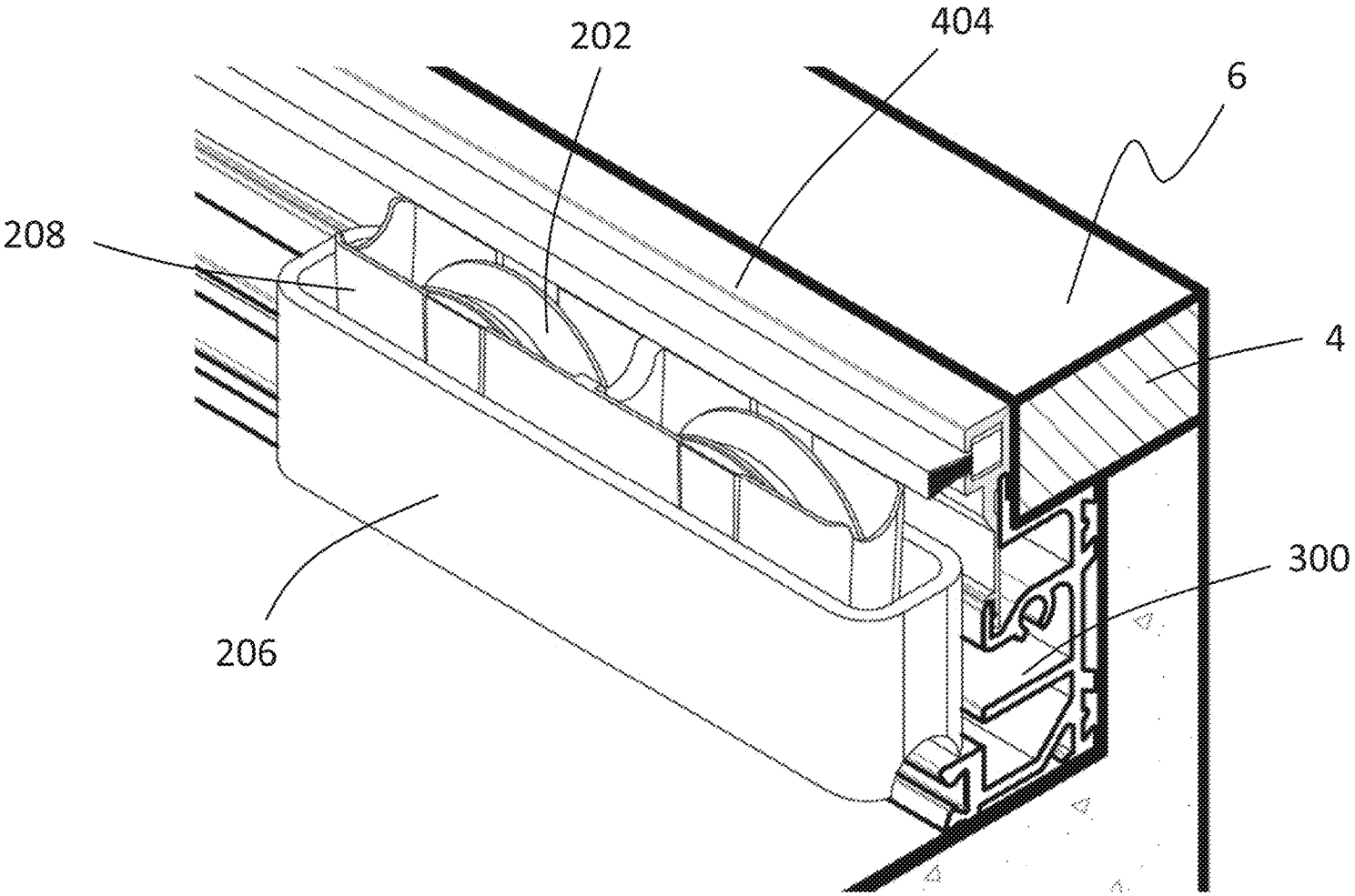
FIG. 11D is a close-up view of an embodiment of the panel system of FIG. 11A.

FIGS. 11B-11D show close-up views of the portions of the panel system 100 indicated in FIG. 11A. FIG. 11B illustrates that the exterior sill 301 can include a pillar 306. The pillar 306 can be adapted to hold and support a non-moveable panel 104 of the panel system 100. The exterior sill 301 can also include a seating surface 308 that is adapted to receive and support a flooring portion 310. The flooring portion 310 can be adapted to blend in visually with the surrounding floor 4 into which the panel system 100 is installed.

FIG. 11C illustrates the outer housing portion 206 of the roller assembly 200 attached to the sill 300. The brush holder 404 is shown installed onto the sill 300. The medial leg 410 of the brush holder 404 can have a keyed feature 420 (e.g., a détente) that interlocks with a corresponding feature 311 on the sill 300. The keyed feature 420 and the corresponding feature 311 can interlock by a friction fit or a snap fit. The keyed feature 420 and the corresponding feature 311 can be adapted so that they can be decoupled by pulling up on the brush holder 404. In this way, the brush holder 404 can be pulled away from the sill 300 to remove the brush holder 404 from the sill 300 and gain access to the roller assembly 200. The keyed feature 420 and the corresponding feature 311 can be recoupled by pressing the brush holder 404 toward the sill 300 to drive the keyed feature 420 and the corresponding feature 311 into an interlocked configuration. In some aspects, the brush holder 404 can be removed from and reattached to the sill 300 non-destructively without using tools.

FIG. 11D illustrates an opposite side view the outer housing portion 206 of the roller assembly 200 attached to the sill 300. The rollers 202 are mounted in the inner housing portion 208, which is in turn mounted in the outer housing portion 206. The outer housing portion 206 is sized to fit snuggly within the sill 300 to stabilize and reduce lateral movement of the rollers 202. The brush holder 404 can be flush with the top surface 6 of the floor 4 when the brush holder 404 is seated onto the sill 300, as shown. In some aspects, the brush holder 404 can be recessed from, or extend beyond, the top surface 6 of the floor 4.

FIG. 12A illustrates the bottom surface of the sill assembly 101, which is the surface of the sill assembly 101 that faces the subfloor 5 (FIG. 2) when the sill 300 is installed on the subfloor 5. The sill assembly 101 can include an exterior sill 301, an intermediate sill 303, and an interior sill 305. The interior sill 305 can run the full length of the threshold that extends from a first wall 10A to an opposing wall 10B, as shown. FIG. 12A illustrates a recess 8 where the leading edge 112 would be situated in the recesses 8 of the opposing wall 10B.

As shown in FIG. 12A, each of the exterior sill 301 and the intermediate sill 303 can be a staggered sill 302 that does not run the full length of the threshold. Each of the exterior sill 301 and the intermediate sill 303 can have a free end 307, as shown. The bottom surface of the sills 301, 303, 305 can include a weep slot 312 that cuts across the bottom surface of the sills 301, 303, 305. The weep slot or weep slot cutout 312 can assist with drainage of incidental water that enters the panel system 100. The weep slot 312 can be located near (e.g., within 5 to 7 inches) of the free end 307 of the sill 301, 303, 305. In the illustrated embodiment, the weep slot 312 is a cut across each of the sills 301, 303, 305 (if applicable) at the same longitudinal location. The weep slot 312 can be a one-inch wide groove that is milled into one or more sills of the sill assembly 101 at a depth of 3/16-inches.

FIG. 12B shows a cross-sectional view of the sill assembly 101 of FIG. 12A. The sills or base 301, 303, 305 can each include seat surfaces or flooring surface 308 adapted to receive flooring portions 310 to help conceal the panel system 100, as described herein. The weep slot 312 can be seen extending across the bottom surface of each of the sills 301, 303, 305.

In some embodiments, the sills or bases 301, 303, 305 can each have two sill extrusions 314 joined together by a polyamide thermal strut, polymer connector, or key 316 which is inserted into extrusion slots or retainers 318 of the sills 301, 303, 305 prior to crimping with sufficient force as to limit the movement between the two sill extrusions 314 and secure the two sill extrusion assembly 314 (see FIGS. 2, 3, 12B, and 14B). The thermal strut 316 can function as a thermal break or barrier to reduce or inhibit heat or thermal transfer between the sill extrusions 314 and sills 301, 303, 305.

In some embodiments, the bases 301, 303, 305 can be joined to each other by butterfly keys 320 which are crimped to secure in place after insertion into key retainers 322 (see FIGS. 2, 3, 12B, 14B). The butterfly keys 320 and key retainers 322 can be used for joining sills 301, 303, 305 in series, for multiple panel assemblies.

In some embodiments, the sills 301, 303, 305 can run or extend longitudinally along the length of the sill assembly 101 between the frame jambs 9. Each sill 301, 303, 305 can have an exterior wall 324 and an interior wall 326 which extend vertically from the bottom of the sill assembly 101 to the flooring surface 308, where the walls 324, 326 turn horizontally to form a platform or flooring surface 308 for the flooring material, before turning vertically again to form the termination guide 328 for the flooring material.

In some embodiments, the sills 301, 303, 305 can have a support ledge 330. The support ledge 330 can be connected to the walls 324, 326. The support ledge 330 can run longitudinally along the length of the each sill 301, 303, 305. The support ledge 330 can support the roller assembly 200 and/or the fixed panel support 340 (see FIGS. 2 and 3). The support ledge 330 can support, connect with, mate with, contact, and/or position the roller assembly 200 and/or the fixed panel support 340 via with any suitable mechanism, such as, for example, interference/friction fit mechanisms, snap fit mechanisms, and the like, which can include using male and female mating parts (e.g., tongue-and-groove corresponding parts).

In some embodiments, the sills 301, 303, 305 can have another securing or second support ledge 332. The securing ledge 332 can be connected to the walls 324, 326. The securing ledge 332 can runs longitudinally along the length of the each sill 301, 303, 305. The securing ledge 332 can have a screw race 334 for assembling the frame 7, such as jamb assemblies 9 and head assemblies 11, of the panel system 100. The securing ledge 332 can have a support clip 311 for the purpose of retaining the brush insert 400 as discussed herein. The securing ledge 332 support clip 311 can have a vertical orientation. The support clip 311 can be the corresponding feature 311 as discussed herein.

The support clip 311 and/or securing ledge 332 can support the roller assembly 200 and/or the fixed panel support 340 (see FIGS. 2 and 3). The support clip 311 and/or securing ledge 332 can support, connect with, mate with, contact, and/or position the roller assembly 200 and/or the fixed panel support 340 via with any suitable mechanism, such as, for example, interference/friction fit mechanisms, snap fit mechanisms, and the like, which can include using male and female mating parts (e.g., tongue-and-groove corresponding parts).

In some embodiments, the sills 301, 303, 305 can have two or more sill extrusions 314. Each sill extrusion 314 can have a bottom 336. The bottoms 336 of two or more sill extrusions 314 can form a trough when the two sill extrusions 314 are joined together with a polyamide strut or butterfly key 316. Water can be diverted through the trough and then through notches or slots 312 cut perpendicularly (relative to the longitudinal direction) through the entire or at least a part of the sill assembly 101 at regular spacing, depending on drainage requirements as discussed herein, and which otherwise, form the bottom 336 of the sill assembly.

Figure 13:
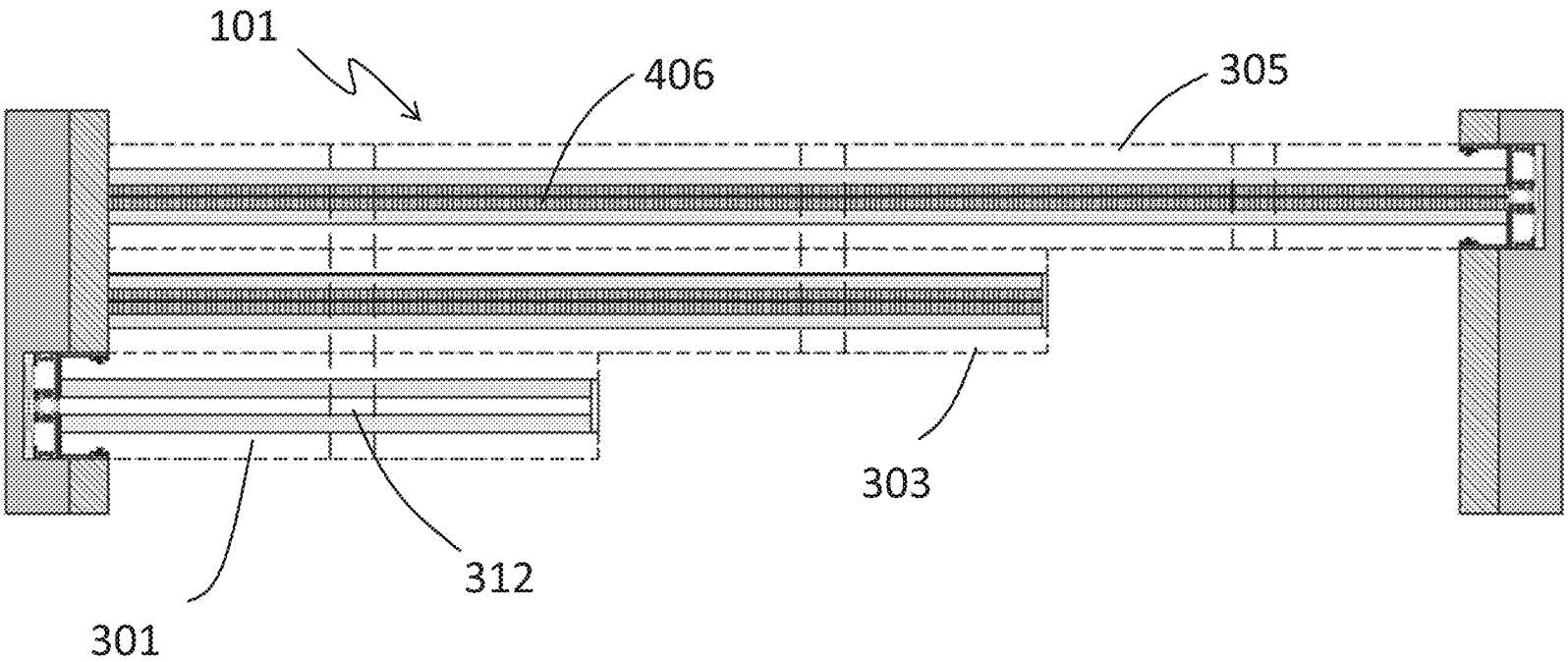
FIG. 13 is a top view of an embodiment of a staggered sill assembly.

FIG. 13 shows a top view of the sill assembly 101. The weep slot 312 on the bottom surface of the sills 301, 303, 305 is indicated in dashed line. As shown in FIG. 13, a large portion of the sills 301, 303, 305 is concealed under the floor with only the brush seal 406 visible from the top view. Thus, the panel system 100 is less noticeable than would be a sill 300 that is installed at the top surface of the floor.

Figure 14A:
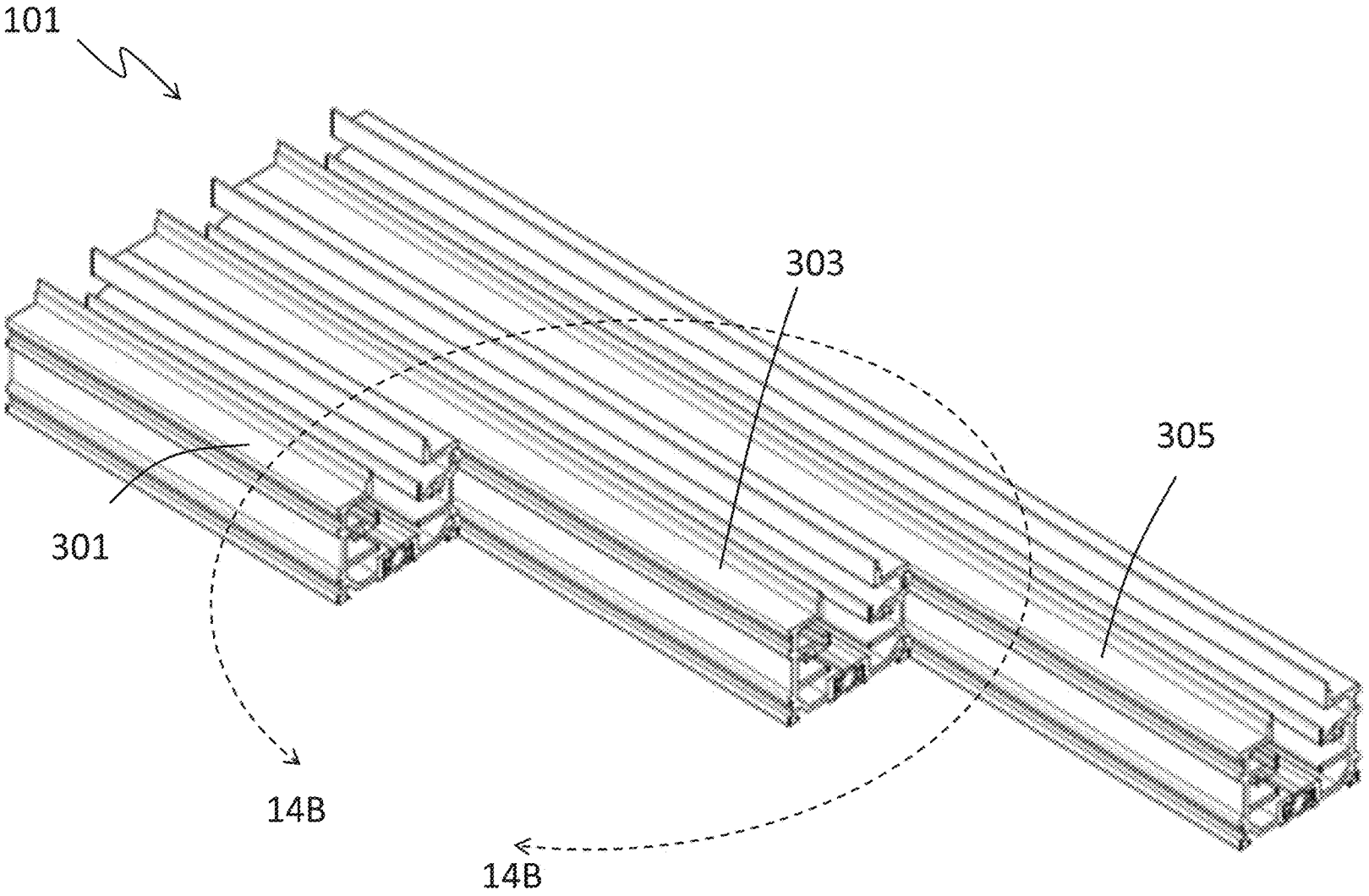
FIG. 14A is an isometric view of an embodiment of a staggered sill assembly.
Figure 14B:
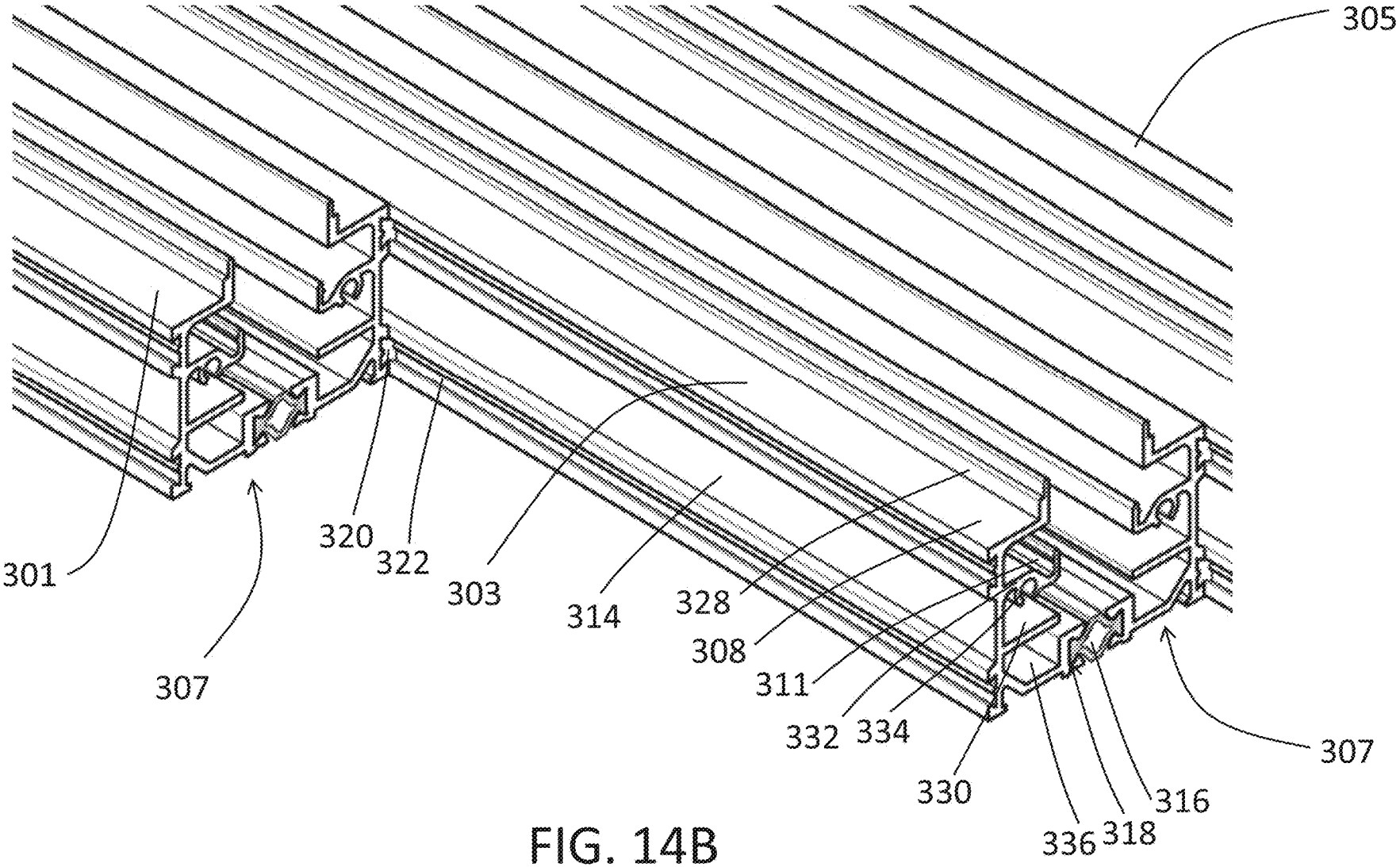
FIG. 14B is a close-up view of an embodiment of the staggered sill of FIG. 14A.

FIG. 14 shows an isometric view of the sill assembly 101 with sills 301, 303, 305. FIG. 14B shows a close-up view of the free ends 307 of the exterior sill 301 and the intermediate sill 303. See description in reference to FIG. 12B above.

Certain Terminology

It should be emphasized that many variations and modifications may be made to the herein-described embodiments, the elements of which are to be understood as being among other acceptable examples. For example, removable bearing assemblies could be used in place of the roller assemblies described herein. All such modifications and variations are intended to be included herein within the scope of this disclosure. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. Furthermore, where the terms "and" and "or" are used in conjunction with a list of items, they are to be interpreted broadly, in that any one or more of the listed items may be used alone or in combination with other listed items.

What is claimed is:

1. A sliding panel system having a moveable panel for providing access to an exterior of a building structure, the sliding panel system comprising:

a frame configured to be positioned at least partially in one or more walls of the building structure, the frame comprising:

a first jamb configured to be positioned vertically in the one or more walls;

a second jamb configured to be installed vertically in the one or more walls, the second jamb configured to be positioned in the one or more walls opposite the first jamb; and a sill configured to be positioned horizontally in a floor of the building structure, the sill configured to be flush with an upper surface of the floor, the sill configured to horizontally extend in a longitudinal direction between the first and second jambs;

a roller assembly configured to be secured in the sill, the roller assembly configured to be in the sill below the upper surface of the floor, the roller assembly comprising:

an outer housing configured to be positioned in the sill below the upper surface of the floor, the outer housing comprising a socket and a stop protrusion;

an inner housing at least partially positioned within the outer housing, the inner housing comprising a boss positioned within the socket of the outer housing, the boss configured to move within the socket such that the inner housing moves about the boss relative to the outer housing, wherein the stop protrusion of the outer housing is configured to contact a surface of the inner housing to limit movement of the inner housing relative to the outer housing;

a first roller positioned at least partially in the inner housing, the first roller configured to rotate about a first axis that is transverse to the longitudinal direction; and a second roller positioned at least partially in the inner housing, the second roller positioned along the longitudinal direction from the first roller, the second roller configured to rotate about a second axis that is transverse to the longitudinal direction; and a moveable panel assembly configured to be installed over the sill and extend between the first and second jambs in the longitudinal direction, the moveable panel assembly configured to move in the longitudinal direction between the first and second jambs to provide access to the exterior from the building structure, the moveable panel assembly comprising:

a panel separating the exterior from the building structure;

a bottom support rail configured to support the panel vertically, the bottom support rail configured to be positioned over the roller assembly, the bottom support rail comprising a bottom rail surface configured to face the sill; and a support blade extending from the bottom support rail perpendicular to the bottom rail surface of the bottom support rail, the support blade comprising a radial surface configured to contact at least one of the first roller or the second roller to move in the longitudinal direction with the first roller configured to rotate about the first axis or the second roller configured to rotate about the second axis, wherein in a first position of the panel along the longitudinal direction, the radial surface of the support blade is configured to contact the first roller to cause the inner housing to move relative to the outer housing such that the first roller is vertically lower than the second roller, and wherein in a second position of the panel along the longitudinal direction, the radial surface of the support blade is configured to contact the first roller and the second roller to cause the inner housing to move relative to the outer housing such that the first roller is substantially level with the second roller along the longitudinal direction.

2. The sliding panel system of claim 1, wherein in a third position of the panel along the longitudinal direction, the radial surface of the support blade is configured to contact the second roller to cause the inner housing to move relative to the outer housing such that the second roller is vertically lower than the first roller.

3. The sliding panel system of claim 1, wherein the inner housing is configured to rotate substantially about the boss within the socket up to a predetermined angle relative to the outer housing.

4. The sliding panel system of claim 3, wherein the predetermined angle ranges from 1 to 5 degrees.

5. The sliding panel system of claim 1, wherein the support blade extends along a width of the bottom support rail.

6. The sliding panel system of claim 1, wherein the bottom support rail and the support blade are formed from a monolithic piece of material.

7. The sliding panel system of claim 1, further comprising a seal configured to contact the upper surface of the floor, wherein the bottom support rail comprises a slot, the slot configured to engage the seal, the seal extending from the slot and from the bottom rail surface of the bottom support rail.

8. The sliding panel system of claim 1, further comprising a non-moveable panel configured to be stationary in another sill, the non-moveable panel comprising another bottom rail, the other bottom rail comprising another support blade configured to extend into the other sill to support the non-moveable panel.

9. The sliding panel system of claim 8, further comprising a fixed panel support configured to be positioned in the other sill, the fixed panel support comprising a support surface corresponding to another radial surface of the other support blade, the other support surface configured to contact the other radial surface to support the non-moveable panel relative to the other sill.

* * * * *